US010407224B2

(12) United States Patent
Kleiner

(10) Patent No.: US 10,407,224 B2
(45) Date of Patent: Sep. 10, 2019

(54) CONTAINER CLOSURE DEVICE AND CONTAINER

(71) Applicant: can2close GmbH, München (DE)

(72) Inventor: Andreas Kleiner, München (DE)

(73) Assignee: can2close GmbH, Munich (DE)

( * ) Notice: Subject to any disclaimer, the term of this patent is extended or adjusted under 35 U.S.C. 154(b) by 0 days.

(21) Appl. No.: 15/579,199

(22) PCT Filed: Jun. 3, 2016

(86) PCT No.: PCT/EP2016/062706
§ 371 (c)(1),
(2) Date: Dec. 2, 2017

(87) PCT Pub. No.: WO2016/193466
PCT Pub. Date: Dec. 8, 2016

(65) Prior Publication Data

US 2018/0127167 A1 May 10, 2018

(30) Foreign Application Priority Data

Jun. 5, 2015 (DE) ..... 10 2015 108 926
Jul. 3, 2015 (DE) ..... 10 2015 110 773

(51) Int. Cl.
*B65D 47/20* (2006.01)
*B65D 43/02* (2006.01)
(Continued)

(52) U.S. Cl.
CPC ..... *B65D 47/20* (2013.01); *B65D 17/4014* (2018.01); *B65D 43/0202* (2013.01);
(Continued)

(58) Field of Classification Search
CPC .. B65D 47/2018; B65D 47/20; B65D 47/125; B65D 47/12; B65D 47/06; B65D 47/261;
(Continued)

(56) References Cited

U.S. PATENT DOCUMENTS 3,952,914 A 4/1976 Vogt
5,680,951 A * 10/1997 Feltman, III ..... A47G 19/2272 220/253
(Continued)

FOREIGN PATENT DOCUMENTS

AT 507950 9/2010
DE 10 2008 011919 A1 9/2009
(Continued)

OTHER PUBLICATIONS

International Search Report (ISR) for PCT/EP2016/062706 dated Sep. 5, 2016.
(Continued)

*Primary Examiner* — Robert J Hicks
(74) *Attorney, Agent, or Firm* — Alfred Y. Chu, Esq.; Brian B. Shaw, Esq.; Harter Secrest & Emery LLP

(57) ABSTRACT

A container closure device includes a closure unit (10) with a closure part (40) for opening and re-closing a container opening (23) and an operating device (50) with an operating part (60) for actuating the closure part, wherein the operating part is rotatably disposed on the closure part and can be rotated from a locked position into an unlocked position. One such operating part has a first and a second locking portion (61, 62), which are configured in such a way that, in the locked position, the two locking portions extend beyond the container opening up to an opening limiting region (24) delimiting the container opening, and that, in the unlocked position, at least one of the two locking portions does not extend beyond the container opening up to the opening limiting region delimiting the container opening.

35 Claims, 33 Drawing Sheets

(51) Int. Cl.
*B65D 47/12* (2006.01)
*B65D 17/28* (2006.01)

(52) U.S. Cl.
CPC ..... *B65D 47/125* (2013.01); *B65D 2517/002* (2013.01); *B65D 2517/0038* (2013.01); *B65D 2517/0046* (2013.01); *B65D 2543/00046* (2013.01)

(58) Field of Classification Search
CPC .... B65D 47/30; B65D 51/18; B65D 17/4014; B65D 17/4012; B65D 17/401; B65D 17/28; B65D 43/0225; B65D 43/0214; B65D 43/0202; B65D 43/12; A47G 19/2272
USPC ..... 220/254.3, 254.2, 254.9, 254.7, 259.5, 220/259.4, 259.3, 259.1, 256.1, 345.1, 220/345.2, 345.3, 345.4, 345.6, 804, 801, 220/714, 713, 715; 222/532, 531, 560, 222/559
See application file for complete search history.

(56) References Cited

U.S. PATENT DOCUMENTS

| | | | | |
|---|---|---|---|---|
| 5,692,633 | A | 12/1997 | Gordon | |
| 6,216,903 | B1 * | 4/2001 | Hirose | A47G 19/2272 220/253 |
| 6,286,703 | B1 | 9/2001 | Munroe | |
| 6,352,166 | B1 * | 3/2002 | Copeland | B65D 47/20 215/387 |
| 8,794,469 | B2 | 8/2014 | Bratsch | |
| 2007/0145055 | A1 | 6/2007 | Gardiner | |
| 2009/0173737 | A1 | 7/2009 | Ramsey et al. | |
| 2009/0206083 | A1 | 8/2009 | Heigl | |
| 2013/0228586 | A1 | 9/2013 | Schandl | |
| 2014/0042164 | A1 | 2/2014 | Zabaleta | |

FOREIGN PATENT DOCUMENTS

| | | | |
|---|---|---|---|
| EP | 1247752 | A1 | 10/2002 |
| FR | 2936227 | A1 | 3/2010 |
| WO | 2007-128810 | A1 | 11/2007 |
| WO | 2007/147 542 | A1 | 12/2007 |
| WO | 2010-031975 | A1 | 3/2010 |
| WO | 2011-026993 | A1 | 3/2011 |
| WO | 2011/124 552 | A1 | 10/2011 |

OTHER PUBLICATIONS

International Written Opinion (WO) for PCT/EP2016/062706 dated Sep. 5, 2016.
Opposition Notice for European Patent 2 555 988, corresponding to Applicant's U.S. Pat. No. 9,463,910 with machine translation.

* cited by examiner

FIG 13 I–I
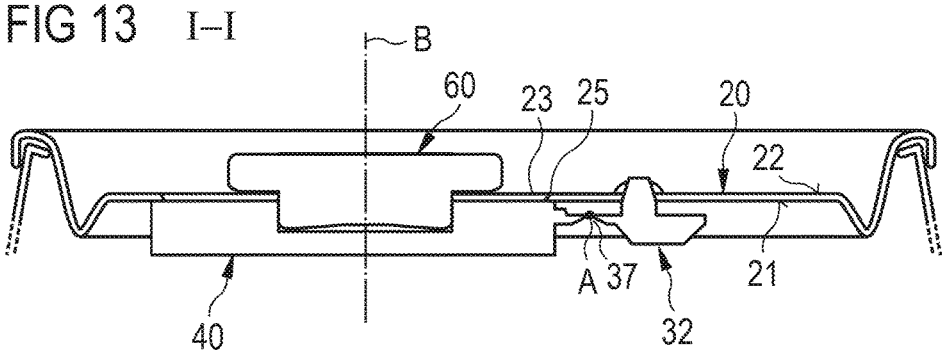
FIG 14 II–II
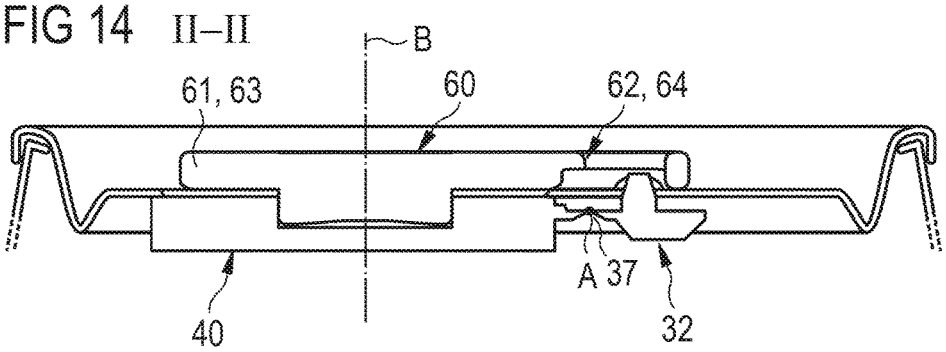
FIG 15 III–III
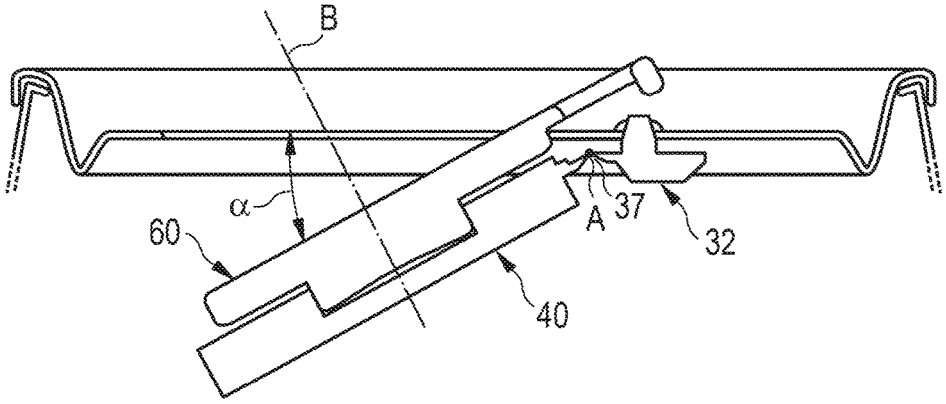

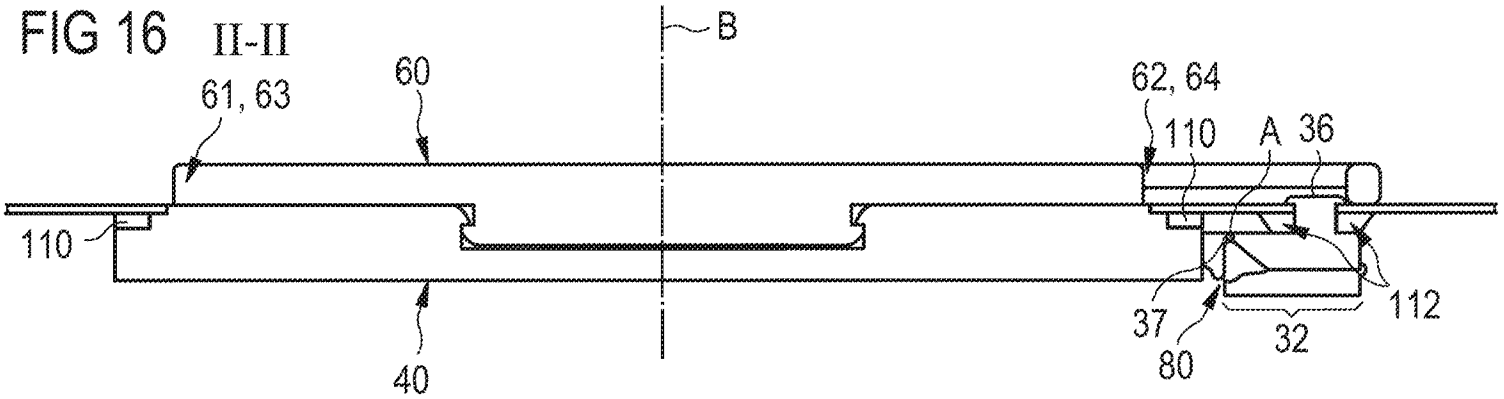
FIG 16 II-II
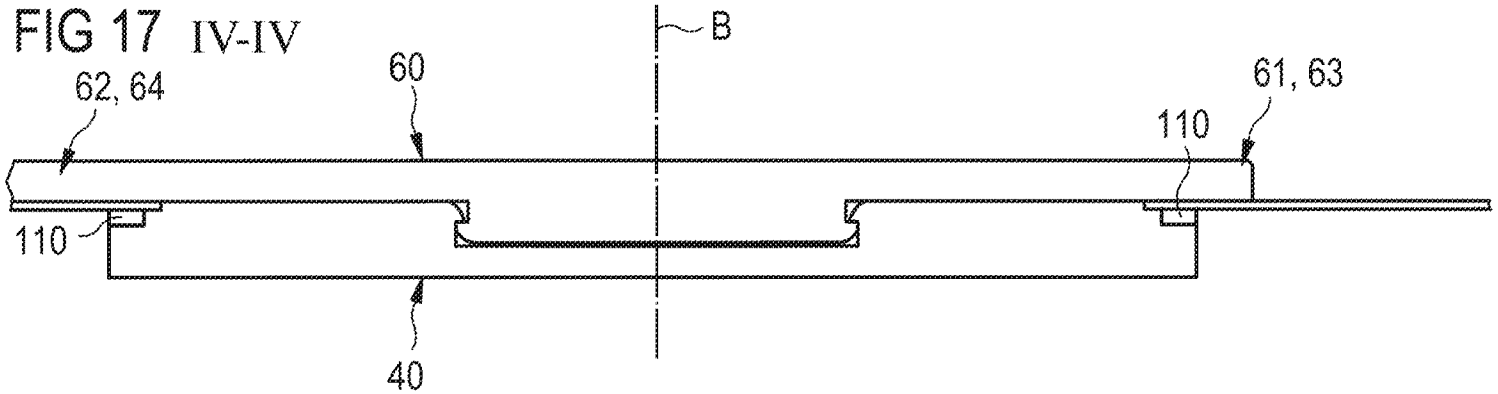
FIG 17 IV-IV

CONTAINER CLOSURE DEVICE AND CONTAINER

BACKGROUND OF THE INVENTION

The invention relates to a container closure device for a container, in particular for a beverage can. Such a container has a container wall with an inner face, an outer face and a container opening. The container closure device comprises a closure unit with a closure part for opening and re-closing the container opening multiple times, wherein the closure part is disposed so as to be pivotable from a closed position into an open position about a first axis extending substantially parallel to the inner face. Further, the container closure device comprises an operating device with an operating part for actuating the closure part, wherein the operating part is disposed on the closure part in a manner rotatable about a second axis.

Such a container closure device is known from WO 2011/124552 A1. This known container closure device has a mechanism for opening and re-closing the container opening multiple times which is easy to operate and which functions well. In the field of re-closable container closure devices, however, there is the desire for providing a re-closable closure that has a simple structure, comprises few components and is simple and cost-effective to produce. In addition, the component height is to be kept small in order to enable both a simple operation and a simple manufacturing process during the assembly of the individual components.

The object of the invention lies in proposing a container closure device that provides a re-closable closure mechanism that has a simple structure, is simple to produce, comprises a small number of components and a small structural height while ensuring easy operability at the same time.

SUMMARY OF THE INVENTION

According to a first aspect of the present invention, a container closure device for a container, in particular for a beverage can, according to claim 1 is proposed in order to achieve the object. The container closure device comprises a container wall with an inner face, an outer face and a container opening, a closure unit with a closure part for opening and re-closing the container opening multiple times, wherein the closure part is disposed on the inner face so as to be pivotable from a closed position into an open position about a first axis extending substantially parallel to the inner face, and an operating device with an operating part for actuating the closure part, wherein the operating part is disposed on the closure part in a manner rotatable about a second axis such that the operating part is connected to the closure part through the container opening and such that the operating part can be rotated from a locked position into an unlocked position. The closure part closes the container opening in the locked position, and the container opening can be unblocked in the unlocked position by pivoting the closure part about the first axis. Further, the operating part comprises a first locking portion and a second locking portion, wherein the first locking portion and the second locking portion are configured in such a way that, in the locked position, the two locking portions extend beyond the container opening up to an opening limiting region delimiting the container opening, and that, in the unlocked position, at least one of the two locking portions does not extend beyond the container opening up to the opening limiting region delimiting the container opening.

For generally understanding of the mode of action and the advantages of the inventive container closure device according to all aspects of the present invention, the general explanations below follow within the context of the present invention:

The container closure device may also be referred to as a re-closable container closure device or as a re-closable closure device. The operating device may also be referred to as an actuating device. Preferably, the container closure device according to the invention is used for a re-closable can, in particular for a re-closable beverage can.

The container wall preferably is a lid so that, consequently, the inner face may also be referred to as the bottom side and the outer face may be referred to as the top side. Alternatively, the container wall may also be a side wall or a bottom of a container.

Advantageously, the container closure device may consist (only) of the closure part, the operating part and a sealing means, i.e. of three components that cooperate with the container wall and the container opening provided therein. A low number of components is thus achieved, which, in addition, have a small structural height, and wherein the closure is easy to operate.

In a preferred embodiment, the closure part and the operating part extend substantially parallel to one another in the locked position, in the unlocked position and during the pivoting movement into the interior of the container for unblocking the opening, and also during the return pivoting movement for closing the opening. In other words, the closure part and the operating part, starting from the unlocked position, are able to pivot together when pivoting into the interior of the container and accordingly pivot together also when pivoting back for closing the container opening, i.e. they remain in a substantially parallel position relative to one another. This makes a small structural height possible.

Further, the present invention preferably provides that, in the locked position, in the unlocked position and during the rotary movement parallel to the container wall, the operating part is preferably orientated substantially parallel to the outer face of the container wall and above the outer face and so as to rest, at least in some portions, on the outer face.

Within the context of the present invention, the container opening can be unblocked, starting from the unlocked position of the operating part, by pivoting the closure part about the first axis, wherein the pivoting of the closure part may occur as a consequence of the positioning and extending direction of the first axis and as a consequence of the own weight of the closure part and/or the operating part. Alternatively or additionally, the pivoting of the closure part may occur by means of lifting an end region of the operating part in a direction substantially perpendicular or oblique to the container wall. Depending on the size and material of the closure part, and depending on the design of the first axis of rotation or the joint, the opening angle to be reached as a consequence of gravity may be affected. Depending on the desired opening angle for the container opening, the closure part may then remain in this intermediate position as the final open position, or the closure part may be additionally pivoted about the first axis by lifting the end of the operating part, so that a larger opening angle can be achieved as the final open position.

Further, the present invention preferably provides that the operating part rests on the closure part in the area of the container opening and is, in particular, directly connected to the closure part, preferably exclusively through the container opening. This connection of the closure part and the operating part is designed in such a way that the operating part is rotatable relative to the closure part. In this case, the axis of rotation of the operating part extends substantially perpendicularly to the closure part. The closure part is attached to the inner face of the container wall with its attachment region, preferably directly, i.e. without an intermediate component. The attachment is carried out in such a way that the closure region of the closure part is pivotable for opening and closing the container opening multiple times.

In the closed position, the bottom side of the operating part preferably rests on the top side of the container wall at least in some portions, and the top side of the closure part rests on the bottom side of the container part at least in some portions.

The container closure device according to the invention makes a simple and flat structure and a low number of components possible, with easy operability at the same time.

Because the first and second locking portions of the operating part, in the locked position, extend beyond the container opening up to the opening limiting region delimiting the container opening, these two locking portions protrude over the container opening, which is supposed to prevent a partial opening or the opening of a gap of the closure from occurring due to deliberately or inadvertently pressing the operating part and/or the closure part down. Furthermore, an improved sealing effect in the locked position can be obtained. The fact that, in the unlocked position, at least one of the two locking portions of the operating part does not extend beyond the container opening up to the opening limiting region delimiting the container opening, makes it possible to easily pivot the closure part about the first axis downwards into the interior of the container, starting from the unlocked position. In the case that one of the two locking portions does not extend beyond the container opening but the other locking portion extends beyond the container opening, the latter locking portion may serve have the purpose that, when the locking portion thereof or a grip portion adjacent thereto is lifted, a pivoting movement of the closure part about the first axis occurs in order to obtain the desired open position. In this case, the protruding locking portion or grip portion may serve as an abutment (surface) on a partial portion or an edge of the opening limiting region in order to be able to apply a torque on the closure part.

In a preferred embodiment, an outer operating part edge (may also be referred to as an outer boundary line) of the operating part, an outer closure part edge of the closure part and a boundary line of the container opening have a substantially identical geometrical course. In other words, there is preferably a congruent shaping of the operating part, the closure part and/or the container opening. In a preferred embodiment, the outer operating part edge, the outer closure part edge and/or the boundary line of the container opening are formed to be oval or as an elongated hole. In this case, the long sides may be formed as straight lines in some portions.

Preferably, the container opening has a substantially oval basic shape or the shape of an elongated hole. In this case, the long sides of the elongated hole may be formed as straight lines in some portions. The curved end regions of the elongated hole may preferably be formed in a semicircular or elliptical shape. On the one hand, the opening limiting region may be delimited by the boundary line and on the other hand, may be delimited by a (virtual) border line extending congruently or substantially parallel thereto. Thus, the opening limiting region advantageously extends around the container opening and preferably has an annular shape and/or an oval shape.

Preferred embodiments of the container closure device according to the first aspect according to claim 1 are now described in accordance with the dependent claims 2 to 6.

In a preferred embodiment, when the operating part is rotated from the locked position into the unlocked position, the two locking portions move along the opening limiting region delimiting the container opening and/or along the boundary line of the container opening.

Preferably, an overlapping region of the locking portion and the opening limiting region may become continuously smaller when the operating part is rotated from the locked position into the unlocked position, and/or the overlapping region may become continuously larger when the operating part is rotated from the unlocked position into the locked position.

In a preferred embodiment, an outer operating part edge of the operating part is formed to be substantially congruent to a boundary line of the container opening, preferably in such a way that the operating part can be pivoted from the locked position into the interior of the container by pivoting the closure part about the first axis, with only a minimal gap being provided between the outer operating part edge and the boundary line of the container opening.

In a preferred embodiment, the first locking portion and/or the second locking portion, respectively, is an end region of the operating part.

In a preferred embodiment, the operating part has a central portion between the first locking portion and the second locking portion, in which the rotatable connection between the operating part and the closure part is provided.

In a preferred embodiment, at least one of the end regions and/or at least one of the locking regions comprises a grip portion configured for being gripped with one or more fingers.

According to a second aspect of the present invention, a container closure device for a container, in particular for a beverage can, according to claim 7 is proposed in order to achieve the object. The container closure device comprises a container wall with an inner face, an outer face and a container opening, a closure unit with a closure part for opening and re-closing the container opening multiple times, wherein the closure part is disposed on the inner face so as to be pivotable from a closed position into an open position about a first axis extending substantially parallel to the inner face, and an operating device with an operating part for actuating the closure part, wherein the operating part is disposed on the closure part in a manner rotatable about a second axis such that the operating part is connected to the closure part through the container opening and such that the operating part can be rotated from a locked position into an unlocked position.

The closure part closes the container opening in the locked position, and the container opening can be unblocked in the unlocked position by pivoting the closure part about the first axis. Furthermore, a displacement mechanism is provided with which, by rotating the operating part relative to the closure part, one of the closure part or the operating part can be moved towards or away from the container wall in a direction substantially extending perpendicularly to the container wall, whereby the operating part and/or the closure part can be pressed against the container wall or detached from it.

This container closure device according to the invention makes it possible that, using the rotation of the operating part relative to the closure part, which has already been initiated anyway, for displacing the operating part from a locked position into an unlocked position (and back) by means of the displacement mechanism, the operating part and/or the closure part can be urged or pressed against the container wall, particularly against the region delimiting the container opening, and also detached from it again.

When rotating the operating part in a first direction of rotation about the second axis, the closure part or the operating part, in a rotating area shortly before reaching the unlocked position, is preferably moved towards the container wall in a direction extending substantially perpendicularly to the container wall. In this manner, the closure device can be brought into a secured closed position (may also be referred to as the secured position), in which the operating part and/or the closure part is urged or pressed against the container wall. This may also be referred to as squeezing the container wall against the closure part and/or the operating part. Preferably, the closure part is pressed against the inner face of the container wall.

In the process, a sealing means provided between the inner face of the container wall and the top side of the closure part can be pressed on or compressed. This enables an improved sealing function, and the closure cannot be readily partially opened by deliberately or inadvertently pressing the closure part or operating part down, forming a gap.

In the case of the reverse rotational movement, i.e., starting from the locked position, the operating part and/or the closure part is detached from the pressed-on position by rotating the operating part relative to the closure part in a second direction of rotation, starting from the locked position along a certain area of rotation, due to the fact that the closure part or the operating part moves away from the container wall again in a direction extending substantially perpendicularly to the container wall.

Thus, the first and second directions of rotation each extend around the second axis, corresponding to the axis of rotation of the operating part. Advantageously, by means of this design of the operating part being rotatable relative to the closure part, a locking and unlocking action may be provided on the one hand, and on the other hand, the displacement mechanism may simultaneously be brought from a secured position, in which the operating part and/or the closure part is pressed against the container wall, into a released position (may also be referred to as a detached position), in which the operating part and/or the closure part is no longer pressed against the container wall.

Preferred embodiments of the container closure device according to the second aspect according to claim 7 are now described in accordance with the dependent claims 8 to 12.

In a preferred embodiment, the displacement mechanism comprises at least one displacement means provided on the container wall, on the operating part and/or on the closure part. Preferably, the displacement means is a projection.

In a preferred embodiment, the displacement means is a control portion shaped so as to cause a control of the movement of the closure part or the operating part towards or away from the container wall.

Preferably, the control portion is formed by an edge or a strip provided on the outer circumference or the inner circumference of the operating part and/or the closure part. Also preferably, the control portion extends in a curved and/or slanted manner.

According to a third aspect of the present invention, a container closure device for a container, in particular for a beverage can, is provided, with an inner face, and outer face and a container wall comprising a container opening. According to claim 13, this container closure device comprises a closure unit with a closure part for opening and re-closing the container opening multiple times, wherein the closure part is disposed so as to be pivotable from a closed position into an open position about a first axis extending substantially parallel to the inner face. The container closure device further comprises an operating device with an operating part for actuating the closure part, wherein the operating part is disposed on the closure part in a manner rotatable about a second axis and can be rotated from a locked position into an unlocked position. In addition, the closure unit comprises a fixing device by means of which, in a fixed position, the closure part can be detachably fixed in the open position and by means of which, in a released position, the closure part can be pivoted between the closed position and the open position.

This container closure device according to the invention makes it possible that, within the course of the pivoting movement of the operating part, which is required anyway for opening the container opening, the closure part can be fixed in the desired open position in a fixed position of the fixing device. The closure part may be pivoted as a consequence of the own weight of the closure part with the operating part disposed thereon, and/or by lifting or pulling up one end of the operating part. Thus, a partially opened position of the closure part and/or a predetermined open position of the closure part may be obtained by means of an opening movement, i.e. the pivoting of the operating part about the first axis. In particular, no displacing movement in different directions or about different axes is required. This equally applies to the reverse displacing movement for releasing the closure part from the fixed position or open position because on the one hand, due to pivoting the closure part back about the first axis by means of the operating part disposed thereon, the fixing device is transferred from the fixed position into the released position, and in addition, the closure part can be returned to the inner face of the container wall in order to close the container opening again.

In preferred embodiments, the container wall with an inner face, an outer face and a container opening can also be considered a component of this container closure device. Furthermore, the operating part may be disposed on the closure part in a manner rotatable about a second axis such that the operating part is connected to the closure part through the container opening. Also, the closure part can close the container opening in the locked position, and the container opening can be unblocked in the unlocked position by pivoting the closure part about the first axis.

Further preferred embodiments of the container closure device according to the third aspect according to claim 13 are now described in accordance with the dependent claims 14 to 18.

In a preferred embodiment, the fixing device is formed by at least one latching device, preferably by two latching devices.

In a preferred embodiment, the latching device has a first latching member and a second latching member, wherein at least one of them is configured to be at least partially elastic, and wherein one of the latching members is provided on a closure region of the closure part serving for closing the container opening, and the other latching member is provided on an attachment region of the closure part serving for attaching the closure unit to the inner face of the container wall.

In a preferred embodiment, the one of the latching members is configured as a latching cam and the other of the latching members as a latching receptacle or latching flange.

In a preferred embodiment, one of the latching members is connected to the attachment region via an articulated connection and/or is integrally formed with the closure part.

In a preferred embodiment, in the fixed position, the latching members are connected to each other positively, frictionally or non-positively, and/or the latching members are spaced apart in the released position.

In a preferred embodiment, the at least one latching member is attached to the closure region of the closure part, particularly to the bottom side of the closure part, or formed integrally therewith. Preferably, the latching member is configured as a hook-shaped or L-shaped flange (seen in cross section). In this case, the one end of the flange is attached to the closure part, and the other end of the flange is formed as a free end which can cooperate with the other latching member in the fixed position of the fixing device. The two ends of the flange may extend substantially perpendicularly relative to each other or at a predetermined angel relative to each other.

Preferably, the other latching member is attached to the attachment region of the closure part, and there, in particular, to the bottom side. In particular, this latching member may be formed integrally with the closure part and be configured, in particular, as a latching cam.

In particular, the free end of the flange may be configured to be elastically bendable in order to come into contact with the other latching member by bending and/or pressing the free end, so that the fixed position of the closure part can be maintained.

Also preferably, the latching cam can be provided with latching webs or latching nubs, which make it possible to retain or reach behind the other latching member in a frictional and/or non-positive manner, particularly in the form of the free end of the L-shaped flange.

Each of the inventive container closure devices explained above according to any one of the above-mentioned three aspects of the present invention and their preferred designs can be configured as follows as preferred embodiments:

In a preferred embodiment, for rotatably connecting the operating part and the closure part, a connection projection and a connection receptacle are provided, wherein the one part of the operating part and the closure part comprises the connection projection and the other one of the operating part and the closure part comprises the connection receptacle.

In a preferred embodiment, the rotatable connection of the operating part and the closure part is configured as a latching connection (clip connection).

In a preferred embodiment, the latching connection has two latching connection means, wherein at least one of them is configured in a partially elastic manner, and wherein one of the latching connection means is provided on the operating part and the other latching connection means on the closure part.

In a preferred embodiment, the latching connection means are formed as latching cams on the connection projection and on the connection receptacle, respectively. In this manner, in the latched state of the connection projection and the connection receptacle, they are engaged in such a way that the operating part and the closure part are rotatable relative to each other.

In a preferred embodiment, the rotatable connection of the operating part and the closure part is configured as a bayonet connection.

In a preferred embodiment, the bayonet connection has two bayonet connection units, wherein the one bayonet connection unit is provided on the operating part and the other bayonet connection unit on the closure part.

In a preferred embodiment, the bayonet connection unit has at least one bayonet flange or one bayonet recess, wherein the bayonet flange or bayonet recess extends substantially parallel to the plane of the operating part or of the closure part.

In a preferred embodiment, the bayonet flange or the bayonet recess of the bayonet connection unit provided on the closure part is disposed on the connection projection, and the bayonet flange or the bayonet recess of the bayonet connection unit provided on the operating part is disposed on the connection receptacle.

Preferably, several bayonet flanges and several bayonet recesses are provided, wherein the several bayonet flanges are preferably provided on the closure part, and there particularly on the connection projection, and the several bayonet recesses are preferably provided on the operating part, and there particularly on the connection receptacle. Both the bayonet flanges and the bayonet recesses are preferably spaced apart and disposed alternatingly along a virtual circle line.

These two bayonet connection units may cooperate in such a way that, when the operating part is placed on the closure part, the bayonet flanges are introduced into the associated bayonet recesses of the other part of the operating part or closure part, and then the operating part and the closure part are rotated relative to each other in order to bring the bayonet connection into its fixed position. Preferably, a latching device, in particular the latching connection mentioned further above, can be provided additionally in order to secure the bayonet connection in its fixed position.

In a preferred embodiment, the closure unit has a closure region formed on the closure part, for closing the container opening, and an attachment region for attaching the closure unit to the inner face of the container wall, wherein the closure part is connected to the attachment region via a joint and the joint provides the first axis.

In a preferred embodiment, the attachment region has at least one projection which, for producing a rivet connection, can be inserted into an attachment opening of the container wall and secured with the container wall.

In a preferred embodiment, a valve device with a valve opening and/or a valve passage is provided for pressure compensation between the container interior and the ambient pressure, wherein the valve device is opened by rotating the operating part from the locked position into the unlocked position and closed by rotating the operating part from the unlocked position into the locked position.

In a preferred embodiment, the valve opening and/or the valve passage is disposed in the closure part, the operating part and/or the sealing means.

In a preferred embodiment, a sealing means is provided which is disposed on the closure unit and/or the operating device.

In a preferred embodiment, the sealing means comprises a first sealing region, which seals the container opening relative to the closure part in the closed position, and/or a second sealing means, which seals the attachment region of the closure unit with respect to the container wall.

In a preferred embodiment, a seal device is provided which is damaged when the container closure device is opened for the first time, wherein the seal device comprises a seal projection and a seal recess, wherein the seal projection is connected to the operating part or the closure part via at least one predetermined breaking point, and the seal recess is provided in the other part of the closure or operating part, wherein, when the operating part is rotated, the seal projection cooperates with the seal recess in such a way that the predetermined breaking point is damaged, in particular bent and/or broken.

In a preferred embodiment, the seal projection is connected to the operating part and the seal recess is formed in the closure part. Preferably, the seal projection is integrally formed with the operating part. Preferably, the seal projection is connected to the operating part via one or more webs (or arms) as the at least one predetermined breaking point. The seal recess may be configured as a cylindrical blind hole or also as an elongated hole.

In a preferred embodiment, the seal projection (prior to the container closure device being opened for the first time) projects into the seal recess and the seal projection strikes against a wall of the seal recess and the predetermined breaking point, which is preferably configured as one or more webs, is damaged when the operating part is rotated (for the first opening). The seal projection may protrude into the seal recess in such a manner that it touches the closure part, in particular the bottom of the recess, in the area of the free end protruding thereinto. Alternatively, a spacing between the end face of the seal projection and the closure part may also be provided.

In a preferred embodiment, the seal recess is formed in the closure part and the seal projection is connected to the operating part. Preferably, the seal projection is permanently connected to the closure part, preferably by means of a substance-to-substance connection or a positive connection, or by being integrally formed.

Preferably, the seal recess is configured as an elongated hole. Also preferably, the elongated hole is in this case configured as a through-hole, i.e., it extends over the entire thickness of the component.

In a preferred embodiment, subsequent to damaging the at least one predetermined breaking point, when rotating the operating part, the operating part can be moved along the seal recess, preferably in the form of the elongated hole, relative to the seal projection. Preferably, the seal projection is connected to the operating part, preferably in an integral configuration, via one or more predetermined breaking points, preferably by means of one or more webs, in the area of the side walls forming the seal recesses. Preferably, the closure part remains in its position when the operating part is rotated, i.e. it does not rotate, whereby the operating part is guided along the stationary seal projection by means of its seal recess.

Preferably, the seal recess is configured with an arcuate shape, also preferably with the shape of a quarter circle, semicircle or full circle. In the case of a quarter-circle, semicircle or full-circle configuration, the center of the circle is preferably located in the region or on the second axis. Thus, the cooperation of the seal projection and the seal recess is able to support the repeated rotary movements for re-opening and re-closing, even after the first opening.

In a preferred embodiment, a first connection is provided between the seal projection and the operating part, which is damaged as the predetermined breaking point when the container closure device is opened for the first time, and a second connection is provided between the seal projection and the operating part, which is not damaged, preferably remains permanent, when the container closure device is opened for the first time.

Preferably, the first connection and/or the second connection is configured as a positive, non-positive and/or substance-to-substance connection. A substance-to-substance connection is particularly preferred, for example by means of welding (e.g. ultrasonic welding) or gluing.

In a preferred embodiment, the seal projection has a first end on which the first connection is formed. Furthermore, the seal projection has a second end on which the second connection is formed. Preferably, the first end is located in the area of the operating part and the second end in the area of the closure part. In other words, preferably, the first end faces towards the operating part and the second end faces towards the closure part.

In a preferred embodiment, the seal projection is connected to the operating part and/or the closure part via at least one web.

Also preferably, the seal projection, in an end region of the seal recess configured as an elongated hole, is integrally connected to the operating part via several webs, wherein the seal projection preferably extends perpendicularly, in a T-shape, L-shape or I-shape relative to the operating part.

In a preferred embodiment, the seal projection extends substantially perpendicularly to the operating part and/or the closure part. In other words, the seal projection may preferably extend (substantially) parallel to the second axis or (substantially) perpendicularly to the first axis.

Preferably, the seal projection comprises at least one seal pin, which is preferably configured with a T-shape, L-shape or I-shape. Alternatively or additionally, the seal projection may have at least one portion extending or lying (substantially) parallel to the operating part or the closure part, wherein the seal projection can preferably be shaped with a T-Shape or L-shape.

Also preferably, several seal projections and/or several seal recesses may also be provided.

In a preferred embodiment, the container wall has only two openings, i.e. the container opening and the attachment opening, by means of which the closure unit can be attached to the container wall, for example by means of a rivet connection.

In a preferred embodiment, the closure unit and/or the operating device is formed integrally, preferably from only one plastic material.

Preferably, the second axis extends substantially perpendicularly to the first axis and/or to the closure part.

Preferably, the operating part rests on the outer face of the container wall. Preferably, the operating part is rotated over an angle of 90° in order to reach the unlocked position from the locked position and vice versa. Preferably, the above-mentioned joints are formed by a thin-walled connecting region, in particular consisting of a flexible material.

In a preferred embodiment, a lever support device is provided, which, during the pivoting movement of the closure part from the open position into the closed position, enables a leverage effect in such a way that the pivoting movement of the closure part towards the inner face of the container wall is supported up to the closed position of the closure part. Thus, the lower edge of the operating part can be brought up above the container wall by pressing downwards onto the end of the operation part (particularly in the area of the grip portion), in order to then enable the rotary movement of the operating part relative to the closure part. At the same time, the top side of the closure part and a sealing means, which may be disposed there if necessary, can be brought to rest or pressed against the bottom side of the container wall.

In a preferred embodiment, the lever support device comprises a support member which is disposed or formed on the operating part or on the container wall. The support member may be integrally formed with the operating part. Preferably, the support member located on the operating part extends substantially perpendicularly to the extension plane of the operating part or at a predetermined angle thereto, e.g. in a range of 10° to 80°, in particular in a range of 30° to 60°. The orientation of the support member depends on its length and the distance with respect to the container wall and the positioning in relation to the first axis.

In a preferred embodiment, the lever support device comprises several support members, wherein at least one of the support members is disposed on the operating part and at least one other one of the support members is disposed on the container wall. Preferably, these support member on the operating part and the container wall are dimensioned and, relative to one another, oriented and arranged in such a way that they cooperate in such a way, over the course of the pivoting movement of the closure part from the open position into the closed position, that the leverage effect on the closure part can be obtained.

In a preferred embodiment, the operating part, on the one hand, comprises a support member, preferably in the form of a flange protruding downwards from the operating part, and on the other hand, the container wall comprises another support member, preferably in the form of a projection protruding upwards from the container wall. This makes it possible for the two support members to come into contact with each other in the area of the final path of movement during the pivoting movement of the closure part from the open position into the closed position, so that the leverage effect can be obtained.

In a preferred embodiment, the support member is a projection or a flange protruding substantially perpendicularly or at an angle from the operating part.

In a preferred embodiment, the support member is disposed in the area of the locking portion or of the end region of the operating part in such a way that the support member is situated adjacent to the first axis. Preferably, the support member is disposed on a grip portion of the operating part.

In a preferred embodiment, the grip portion of the end region of the operating part extends in an angled or curved manner relative to the operating part or the extension plane thereof. In other words, the grip portion of the end region of the operating part may extend at an angle relative to the extension plane of the operating part.

In a preferred embodiment, the support member is disposed on the container wall. Preferably, the support member is an integral component of the container wall. This support member may be configured as an embossing in the container wall and be formed, for example, in a V-shape.

In a preferred embodiment, the operating part has a top side, a bottom side and a side edge, wherein the side edge and/or the bottom side has at least one run-up surface portion which extends in a slanted or curved manner and is positioned and configured in such a way that the run-up surface portion, in a position of the operating part shortly before reaching the unlocked position, cooperates as a run-up surface with the container wall. In this way, the operating part can be brought into the unlocked position and, beyond that, into the locked position.

In a preferred embodiment, several run-up surface portions are provided which are positioned on opposite sides of the operating part.

In a preferred embodiment, viewed in a section extending perpendicularly to the container wall, the closure part has a component thickness that varies in a continuous or step-shaped manner. Preferably, the bottom side of the closure part is formed convexly. Alternatively or additionally, the bottom side can be configured in a step-shaped manner.

According to other aspects of the present invention, the following combinations of claims 1 to 55 are possible. A container closure device comprising the features according to any one of the claims 1 to 6 in combination with the features according to any one of the claims 7 to 12 and/or in combination with the features according to any one of the claims 13 to 17 and/or in combination with the features according to any one of the claims 19 to 55.

A container according to the invention, preferably a can, and more preferably a beverage can, comprises a container closure device according to any one of the claims 1 to 57. Here, the container can be provided with a container wall with an inner face, an outer face and a container opening for emptying the contents of the container. Preferably, the container wall is a lid of the container so that, consequently, the inner face may also be referred to as the bottom side of the lid and the outer face may be referred to as the top side of the lid. Alternatively, the container wall may also be a side wall or a bottom of the container. The container wall is preferably made from metal, particularly from aluminum.

BRIEF DESCRIPTION OF THE DRAWING FIGURES

Other details and advantages of the closure devices according to the invention are apparent from the preferred exemplary embodiments described below. In the drawings, which depict the exemplary embodiments merely schematically, the detailed illustrations are described briefly below.

FIG. 13 is a cross section along the line I-I from FIG. 10.

FIG. 14 is a cross section along the line II-II from FIG. 11.

FIG. 15 is a cross section along the line III-III from FIG. 12.

FIG. 16 is a cross section analogous to FIG. 14 in the unlocked position, with an additional depiction of a fixing device.

FIG. 17 is a cross section analogous to FIG. 13 in the locked position and with a depiction of the fixing device.

DETAILED DESCRIPTION OF THE INVENTION

Figure 1:
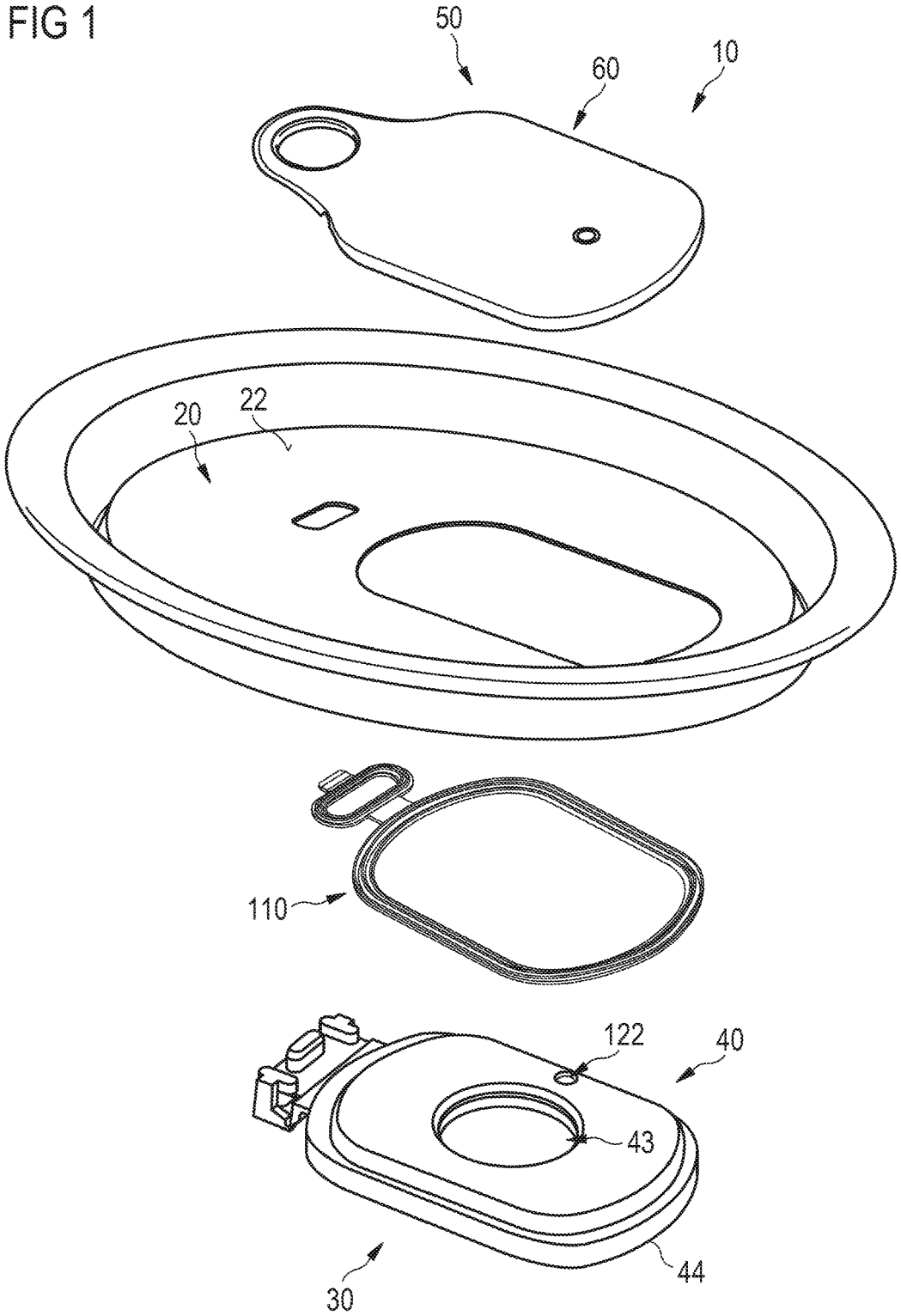
FIG. 1 is an exploded view of a container closure device according to the invention, with an illustration of an operating part, a closure part, a sealing means and a container wall in the form of a lid.

Several preferred embodiments are described below, particularly with respect to the three aspects explained above. In these embodiments, identical features or components have the same reference numerals.

First Embodiment

First, a first embodiment of a container closure device according to the invention is described, which comprises all three of the above-mentioned aspects of the present invention and additional preferred embodiments.

Figure 2:
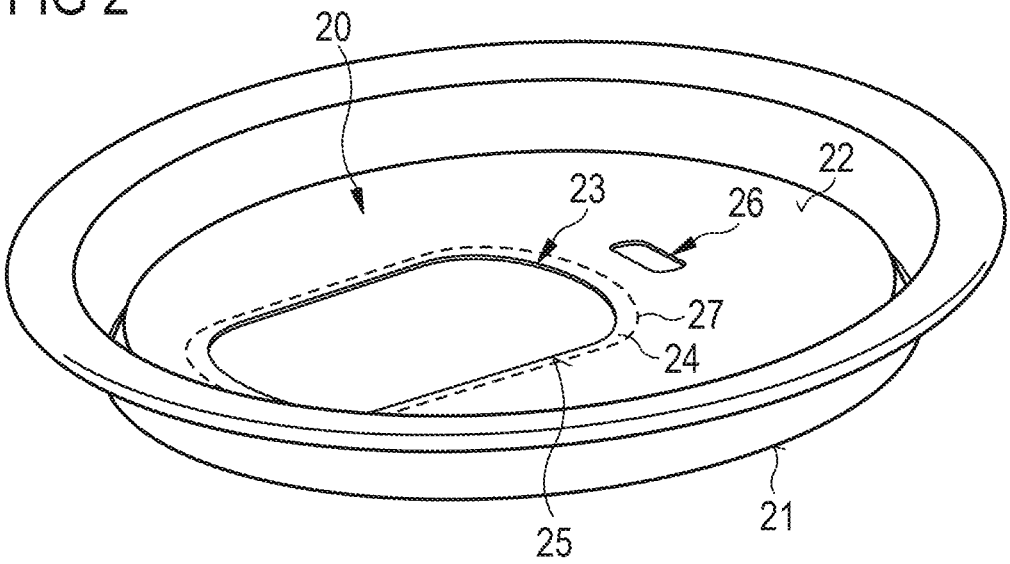
FIG. 2 is a perspective view of the container wall in the form of a lid.
Figure 3:
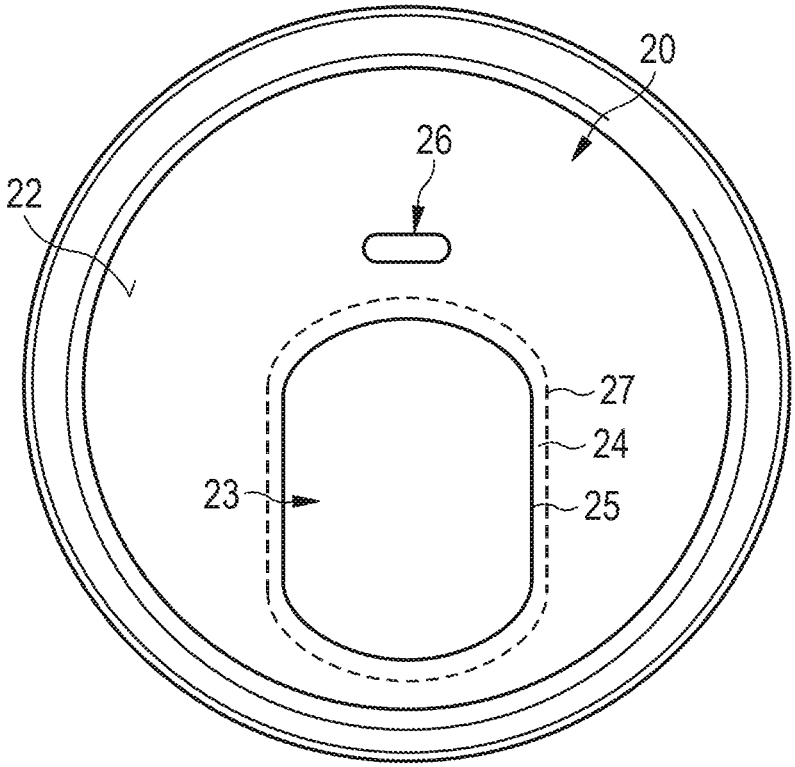
FIG. 3 is a plan view of the container wall according to FIG. 2.

First, reference is made, in particular, to FIGS. 1 to 17. According to this, a container closure device 10 according to the invention for a container, which is, in particular, configured in the form of a beverage can, comprises a container wall 20 (in the form of a lid) with an inner face 21, and outer face 22 and a container opening 23 for emptying the contents of the container (see, in particular, FIGS. 1 to 3).

The container closure device 10 comprises a closure unit 30 with a closure part 40 for opening and re-closing the container opening 23 multiple times, and an operating device 50 with an operating part 60 for actuating the closure part 40 (see, in particular, FIGS. 1 to 7). The closure part 40 is disposed on the inner face 21 so as to be pivotable about a first axis A extending (substantially) parallel to the inner face 21 and is displaceable from a closed position into an open position. The operating part 60 is disposed on the closure part 40 in a manner rotatable about a second axis B, such that the operating part 60 can be rotated from a locked position into an unlocked position (and vice versa). Preferably, the operating part 60 is further disposed on the closure part 40 in a manner rotatable about a second axis B such that the operating part 60 is connected to the closure part 40 through the container opening 23. The axes A and B preferably extend (substantially) perpendicularly to each other. The axis A is preferably situated slightly below the inner face 21 and is provided by the closure unit 30 or the closure part 40. The axis B, in the locked position and in the unlocked position, preferably extends (substantially) perpendicularly to the container wall 20, to the closure part 40 and/or to the operating part 60. The closure part 40 closes the container opening 23 in the locked position, and the container opening 23 can be unblocked in the unlocked position by pivoting the closure part 40 about the first axis A. In other words, the operating part 60 and the closure part 40 are still orientated (substantially) parallel to the container wall in the unlocked position.

Figure 10:
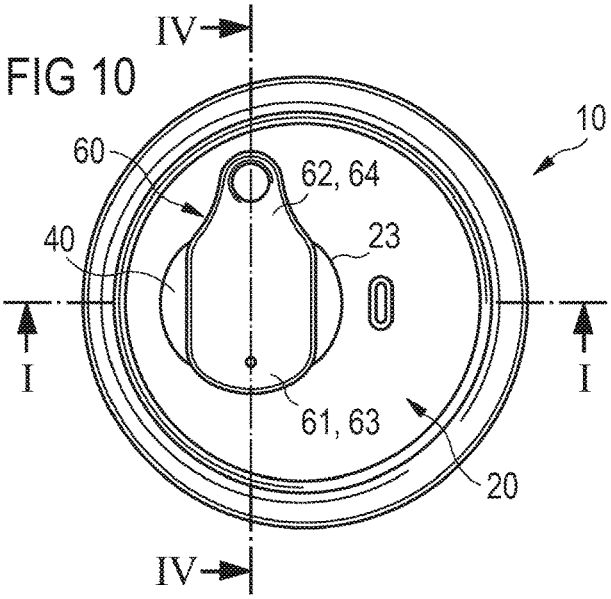
FIG. 10 is a plan view of the assembled container closure device according to the invention of FIG. 1 in the locked position.
Figure 11:
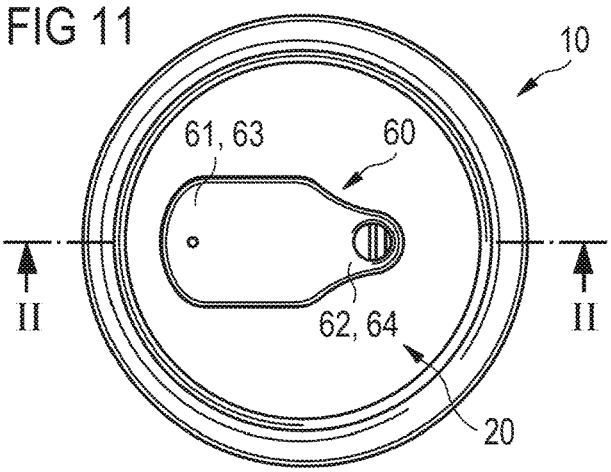
FIG. 11 is a top view analogous to FIG. 10, wherein the container closure device is in the unlocked position.
Figure 12:
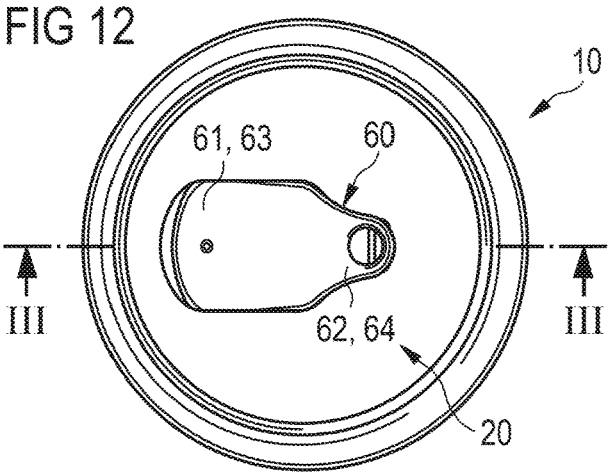
FIG. 12 is a plan view analogous to FIG. 11, wherein the closure part is pivoted into the interior of the container (open position).

In this context, the FIGS. 10 and 13 show the locked position, and the FIGS. 11 and 14 show the unlocked position. Furthermore, FIGS. 12 and 15 show an at least partially opened position of the closure part 40 with an opening angle a, due to pivoting the closure part 40 about the first axis A into the interior of the container.

Figure 18:
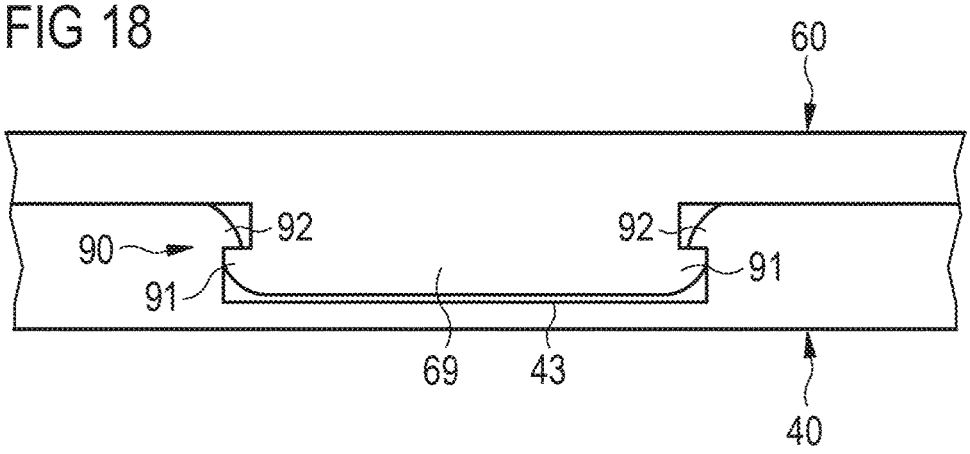
FIG. 18 is an enlarged illustration of a portion of the rotatable connection between the closure part and the operating part according to a first variant.

Both in the locked position and the unlocked position, the operating part 60 is connected to the closure part 40 (in particularly exclusively) through the container opening 23, wherein the operating part 60 is disposed on the closure part 40 in a manner rotatable about the second axis B. For rotatably connecting the operating part 60 and the closure part 40, a connection projection 69 and a connection receptacle 43 are provided, wherein the one part of the operating part 60 and the closure part 40 comprises the connection projection 69 and the other one of the operating part 60 and the closure part 40 comprises the connection receptacle 43. In this case, the rotatable connection is preferably configured as a latching connection 90 (clip connection) by means of the connection projection 69 and the connection receptacle 43 (see FIGS. 5, 6, 13-17, 18). For this purpose, the operating part 60 is pressed with its bottom side (see FIG. 5) onto the top side of the closure part 40 (see FIG. 1) in such a way that the connection projection 69 and the connection receptacle 43 engage with each other and are rotatable relative to each other about the second axis B in the engaged arrangement. The engaged arrangement is shown, in particular, in FIG. 18. Here, the latching connection 90 has two latching connection means 91, 92, wherein at least one of them is configured in a partially elastic manner in order to enable the engagement, and wherein one latching connection means 91 is provided on the operating part 60 and the other latching connection means 92 on the closure part 40. The latching connection means 91, 92 are formed as latching cams and are integrally formed with the connection projection 69 and the connection receptacle 43. According to FIG. 18, the connection projection 69 is integrally formed with the operating part 60 and protrudes from the bottom side of the operating part 60. The connection receptacle 43 is preferably configured as a recess in the closure part 40.

Figure 19:
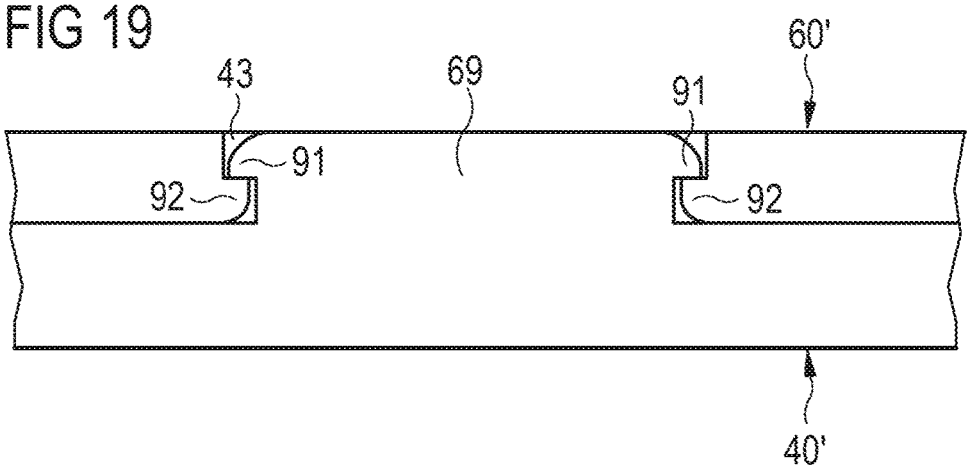
FIG. 19 is an enlarged illustration of a portion of the rotatable connection between the closure part and the operating part according to a second variant.
Figure 20:
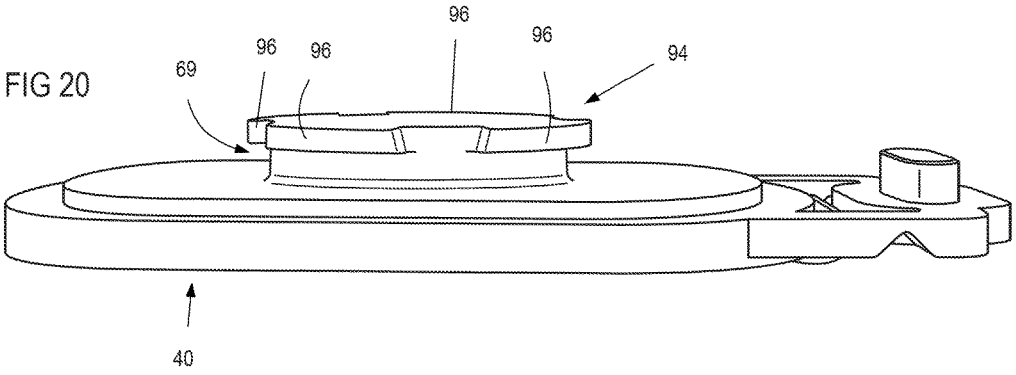
FIG. 20 is a perspective side view of an embodiment of the closure part of the container closure device according to the invention with a bayonet connection.
Figure 21:
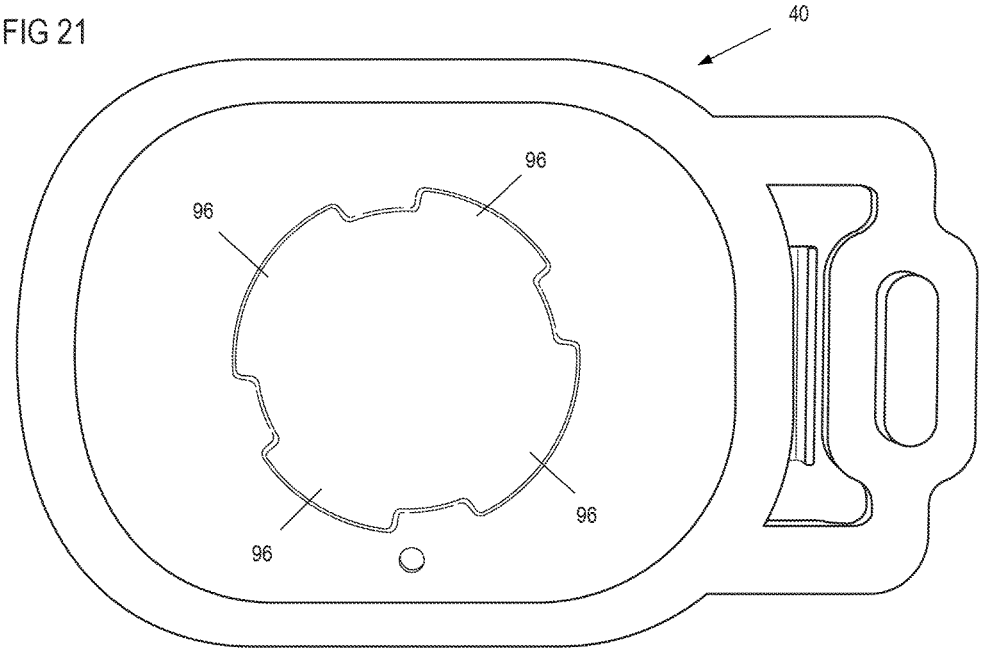
FIG. 21 is a schematic plan view of the closure part according to FIG. 20.
Figure 30:
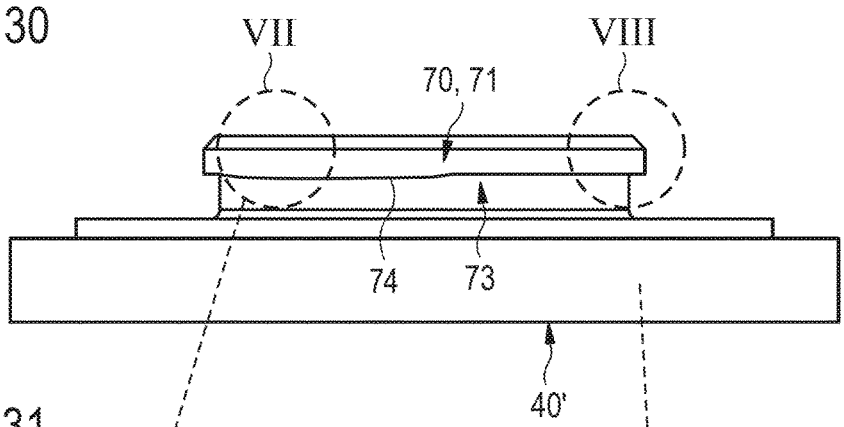
FIG. 30 is a schematic partial illustration of a container closure device according to the invention with a displacement mechanism in a third variant.
Figure 31:
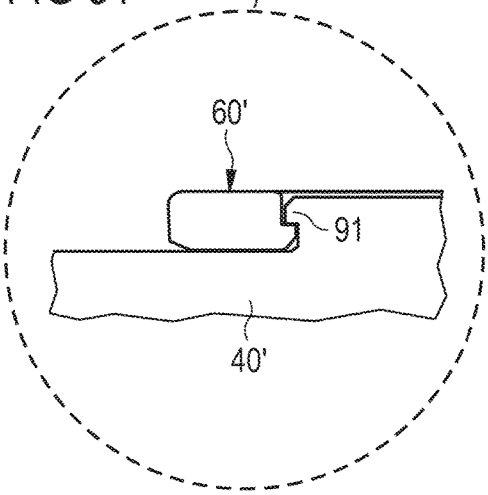
FIG. 31 shows in an enlarged illustration portions of the detail VII from FIG. 30.
Figure 32:
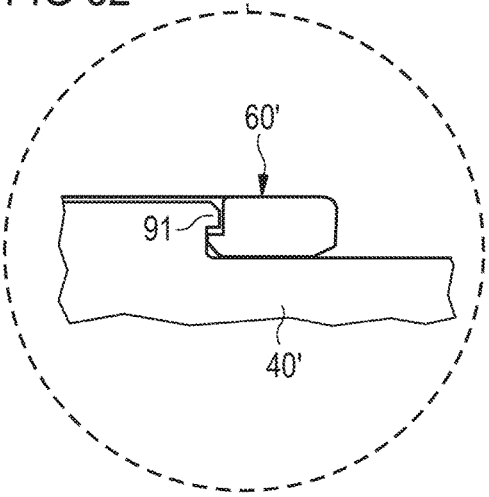
FIG. 32 shows an enlarged illustration of the detail VIII from FIG. 30.

Alternatively, and as shown in FIG. 19, the connection projection 69 may be a component of the closure part 40', and the connection receptacle 43 may be a component of the operating part 60'. Furthermore, the connection projection 69 may be configured to be annular, disk-shaped and/or web-shaped (see, in particular, FIGS. 5, 18 and 30).

Referring to FIGS. 20 to 23, an alternative embodiment of the rotatable connection of the operating part 60 and the closure part 40 is described below. For this purpose, the rotatable connection of the operating part 60 and the closure part 40 is configured as a bayonet connection. In this case, the closure part 40 preferably comprises the connection projection 69, and the operating part 60 comprises the connection receptacle 43, as is indicated in FIG. 19.

Figure 22:
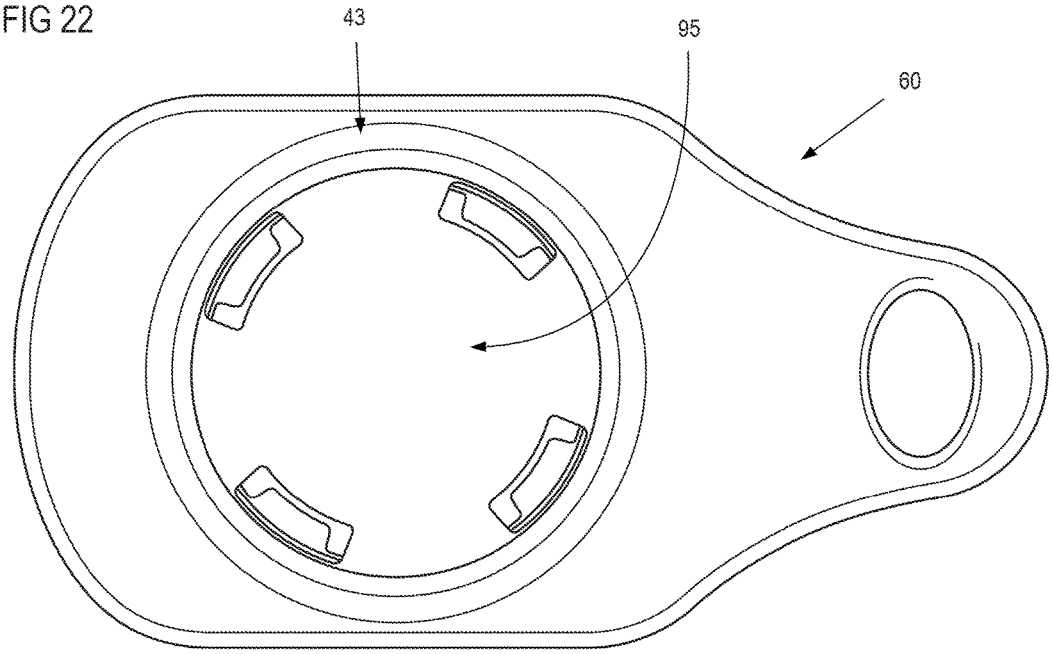
FIG. 22 is a plan view of an embodiment of the operating part with a bayonet connection.
Figure 23:
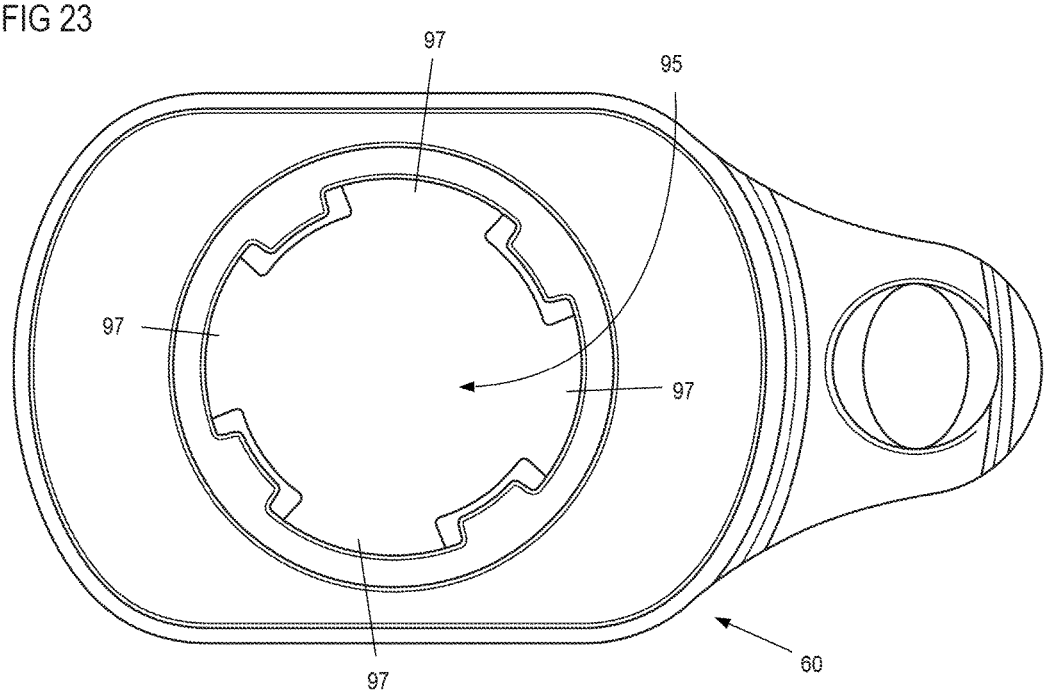
FIG. 23 is a bottom view of the operating part according to FIG. 22.

The bayonet connection has two bayonet connection units 94 and 95, wherein the one bayonet connection unit 94 is provided on the closure part 40 (see FIGS. 20 and 21) and the other bayonet connection unit 95 is provided on the operating part 60 (see FIGS. 22 and 23).

The bayonet connection unit 94 has at least one bayonet flange 96, wherein the bayonet flange 96 extends substantially parallel to the plane of the closure part 40. As shown in the FIGS. 20 (side view) and 21 (plan view), the bayonet connection unit 94 has several, for example four, bayonet flanges 96. Here, the bayonet connection unit 94 is disposed on the connection projection 69 already described above (see above, regarding FIG. 19). Preferably, the connection projection 69 protrudes upwards from the closure part 40, and the bayonet connection unit 94 is formed on the outer free end of the connection projection 69.

The bayonet connection unit 95 has at least one bayonet recess 97, wherein the bayonet recess 97 extends substantially parallel to the plane of the operating part 60. As shown in the FIGS. 22 (plan view) and 23 (bottom view), the bayonet connection unit 95 has several, for example four, bayonet recesses 97. Here, the bayonet connection unit 95 is disposed on the connection receptacle 43 already described above (see above, regarding FIG. 19). Preferably, the connection receptacle 43 forms a depression or an opening, and the bayonet connection unit 95 is formed on the edge or in the edge region of the connection receptacle 43.

Both the bayonet flanges 96 and the bayonet recesses 97 are preferably spaced apart and disposed alternatingly along a virtual circle line in order to make the bayonet connection possible.

These two bayonet connection units 94, 95 may cooperate in such a way that, when the operating part 60 is applied to or placed on the closure part 40, the bayonet flanges 96 are introduced into the associated bayonet recesses 97 until they are situated offset from one another in adjacent planes of different heights, viewed in a side view. Then, the operating part 60 and the closure part 40 are rotated relative to each other in a plane parallel to the operating part 60 or the closure part 40 in order to bring the bayonet connection into its fixed position. Preferably, a latching device, in particular the latching connection 90 mentioned further above, can be provided additionally in order to secure the bayonet connection in its fixed position.

Figure 4:
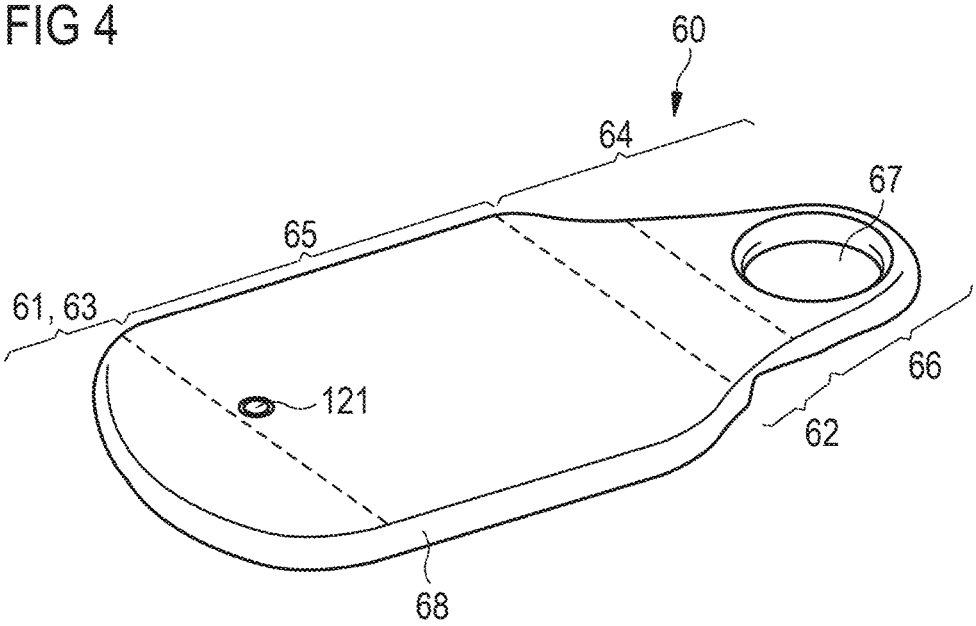
FIG. 4 is a perspective view of the top side of the operating part.

Further, it is provided, as is apparent from FIG. 4 in particular, that the operating part 60 has a first end region 63 and a second end region 64 and an intermediate central portion 65. Preferably, the first end region 63 forms a first locking portion 61, and the second end region 64 forms a second locking portion 62. The locking portions 61, 62 and/or the end regions 63, 64 may be used for operating the operating part 60. The central portion 65 serves for the formation of the rotatable connection between the operating part 60 and the closure part 40 already explained above. The operating part 60 may comprise a grip portion 66 with a hole 67. Alternatively, the hole 67 may be omitted. The grip portion 66 serves for gripping with one or more fingers, for operating the operating part 60.

The first locking portion 61 and the second locking portion 62 are configured in such a way that, in the locked position, the two locking portions 61, 62 extend beyond the container opening 23 up to an opening limiting region 24 delimiting the container opening 23 (see, in particular, FIGS. 10, 13, 17). In the unlocked position, at least one of the two locking portions 61, 62 does not extend beyond the container opening 23, and thus not into the opening limiting region 24 delimiting the container opening, either (see, in particular, FIGS. 11, 14, 16). Starting from the unlocked position, the operating part 60 can pivot downwards into the interior of the container together with the closure part 40 (see FIGS. 12, 15).

The pivoting may occur as a consequence of the positioning and extending direction of the first axis A and as a consequence of the own weight of the closure part 40 and/or the operating part 60. Alternatively or additionally, the pivoting of the closure part 40 may occur by means of lifting the second end region 64 of the operating part 60 in a direction substantially perpendicular or oblique to the container wall 20. Depending on the size and material of the closure part 40 and the operating part 60 disposed thereon, and depending on the design of the joint 37, the opening angle a to be reached as a consequence of gravity may be affected. Depending on the desired opening angle, the closure part 40 may then remain in this intermediate position as the final open position, or the closure part 40 may be additionally pivoted about the first axis A by lifting the second end region 64, so that a larger opening angle can be achieved as the final open position.

The container opening 23 is delimited by a boundary line 25. Preferably, the container opening 23 has a substantially oval basic shape or the shape of an elongated hole. In this case, the long sides of the elongated hole may be formed as straight lines in some portions. The curved end regions of the elongated hole may preferably be formed in a semicircular or elliptical shape. On the one hand, the opening limiting region 24 is delimited by the boundary line 25 and on the other hand, is delimited by a (virtual) border line 27 extending congruently or substantially parallel thereto. Thus, the opening limiting region 24 extends around the container opening 23 and has an annular shape and/or an oval shape.

Figure 5:
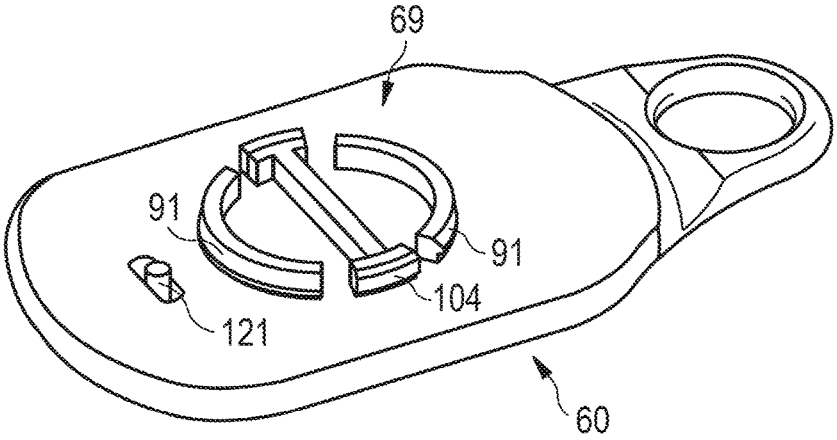
FIG. 5 is a perspective view of the bottom side of the operating part.

Alternatively, the operating part 60 shown, in particular, in FIGS. 4 and 5 may also be configured totally without a grip portion 66, so that only the central portion 65 and the two locking portions 61, 62 or the two end regions 63, 64 are provided, and that therefore, the operating part 60 could also have the shape of an elongated hole or an oval shape.

As is apparent from a synopsis of FIGS. 1 to 7, an outer operating part edge 68 of the operating part 60 is formed to be substantially congruent to the boundary line 25 of the container opening 23, in such a way that only a minimal gap with a constant width is provided between the outer operating part edge 68 and the boundary line 25, so that the operating part 60 can be pivoted from the locked position into the interior of the container by pivoting the closure part 40 about the first axis A.

When the operating part 60 is rotated from the locked position into the unlocked position, the two locking portions 61, 62, at least in some portions, move along the opening limiting region 24 and/or along the boundary line 25 of the container opening 23. During the rotary movement from the locked position into the unlocked position, an overlapping area of the first locking portion 61 with the opening limiting region 24 and an overlapping area of the second locking portion 62 with the opening limiting region 24 become continuously smaller. Accordingly, the aforementioned respective overlapping area in each case becomes continuously larger during a reverse rotary movement from the unlocked position into the locked position.

For pivotably attaching the closure part 40 to the inner face 21 of the container wall 20 (see, in particular, FIGS. 14, 15 and 33 to 37), the closure unit 30 or the closure part 40 comprises a joint 37, which is configured in the form of a thin-walled material cross section, connects the closure region 31 to an attachment region 32 in an articulated manner and provides the first axis A.

The attachment region 32 is indicated, for example, in the FIGS. 6 and 13 to 15 and shown more specifically in FIGS. 33 to 37. The attachment region 32 is preferably integrally formed with the closure region 31, i.e. the closure unit 30 consisting of the closure region 31 and the attachment region 32 is produced integrally from a single material, preferably from an injection-molding material, e.g. plastic.

A main body 33 of the attachment region 32 comprises a first main body portion 38 and a second main body portion 39. Furthermore, the attachment region 32 comprises another joint 84, which is also configured in the form of a thin-walled material cross section and connects the first main body portion 38 to the second main body portion 39 in an articulated manner.

Figure 33:
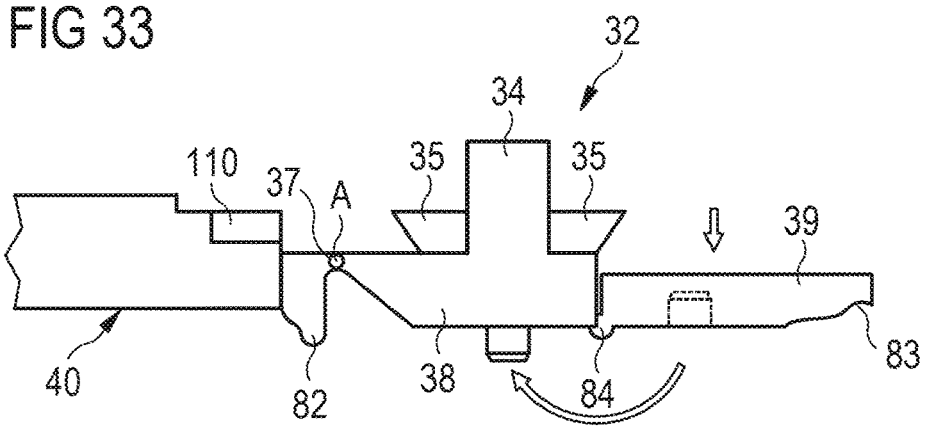
FIG. 33 is a schematic partial section through a container closure device according to the invention with a fixing device in a position of being folded open.
Figure 34:
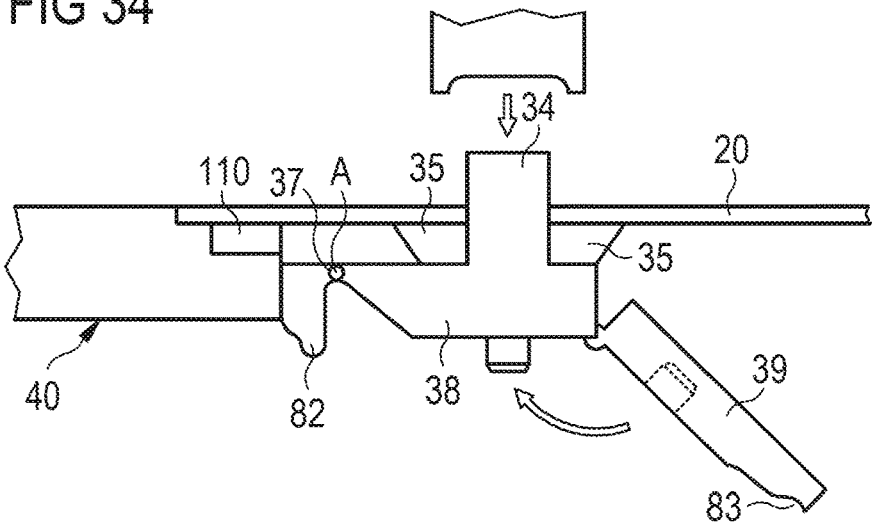
FIG. 34 is a schematic partial section according to FIG. 33 with the fixing device in a state of being partially folded together.
Figure 35:
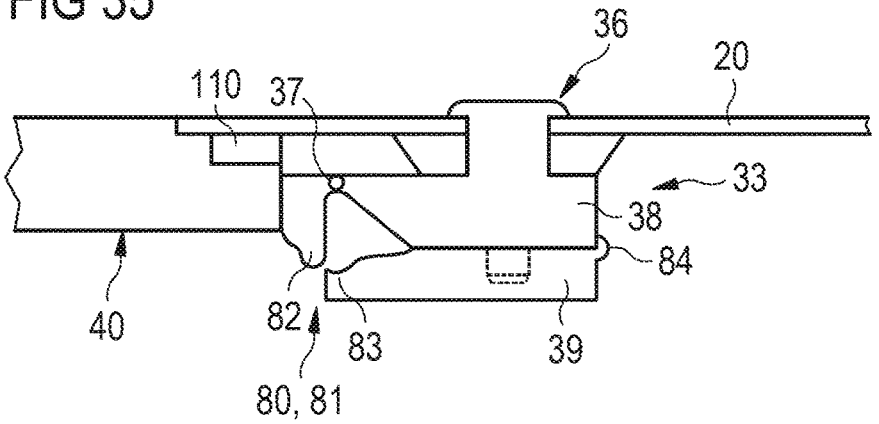
FIG. 35 is a schematic partial section according to FIG. 33 with the fixing device in a state of being folded together.
Figure 36:
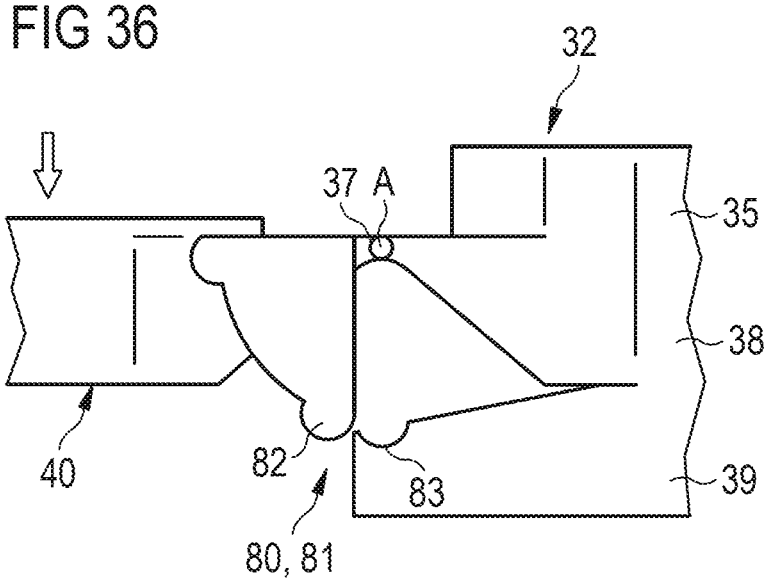
FIG. 36 is an enlarged portion of the fixing device from FIGS. 33 to 35 in a released position.

This configuration of the joints 37 and 84 make is possible for the closure unit 30 to be produced in the flat shape shown in FIG. 33 simply by means of an injection-molding process, for example, in a corresponding mold, and that then, the second main body portion 39 can be folded around due to the elasticity resulting from the joint 84 being thin-walled, until the position according to FIG. 35 has been reached. In this case, a projection may be provided on the bottom side of the first main body portion 38, which engages into an associated recess in the second main body portion 39 during the folding process. For example, a latching connection may be formed between this projection and the receptacle. Alternatively, a substance-to-substance connection of the portions 38 and 39 may be provided, for example by means of gluing.

For abutment against the inner face 21, the main body 33 further has one or more supporting regions 35, which protrude upwards from the main body 33. Furthermore, a projection 34 protrudes upwards from the main body 33, which is routed through an attachment opening 26 of the container wall 20 for attachment, until the supporting region 35 comes to abut against the inner face 21. Then, the protruding part of the projection 34 can be deformed for forming a rivet connection 36 (see FIGS. 34 and 35).

Figure 6:
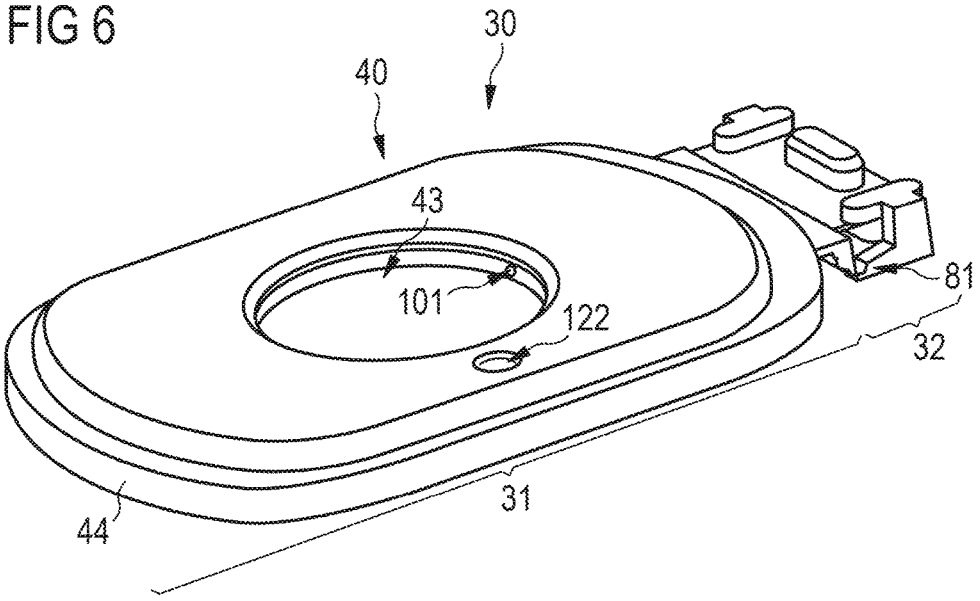
FIG. 6 is a perspective view of the top side of the closure part.

The sealing means 110 of the container closure device 10 is explained in more detail with reference to the FIGS. 1, 8, 9, 16, 17, in particular. The sealing means can be disposed on the closure unit 30 and/or the operating device 50 and serves for closing the container opening 23 in the locked position in a gas and/or liquid-tight manner. Preferably, the sealing means 110 is attached to the closure part 40 in the area of the outer closure part edge 44. As is shown in FIGS. 1 and 6, for example, the edge region or the top side of the closure part 40 may have a stepped portion or a sealing means attachment region for attaching the sealing means 110.

The sealing means 110 (see FIGS. 8, 9) comprises a first sealing region 111, a second sealing region 112 and a connecting region 113 connecting the first sealing region 111 to the second sealing region 112. In the closed position, the first sealing region 111 seals the container opening 23 relative to the closure part 40. The second sealing region 112 seals the attachment portion 32 with respect to the container wall 20. In particular, the area of the rivet connection 36 is sealed in this case. The connecting region 113 substantially serves for enabling an integral manufacture of the sealing means 110 in order to then dispose the sealing means 110 on the closure part 40 in a simple manner. The sealing means may preferably comprise one or more sealing lips.

The valve device 100, which is provided for pressure compensation between the container interior and the ambient pressure, is explained in more detail below. This valve device 100 is indicated in the FIGS. 1 and 6 and shown in more detail in the FIGS. 40 to 44. Basically, the valve device 100 comprises a valve opening 101 and/or a valve passage 102. The valve device 100 is opened by rotating the operating part 60 from the locked position into the unlocked position and closed by rotating the operating part 60 from the unlocked position into the locked position. The valve opening 101 and/or the valve passage 102 may be disposed in/on the closure part 40, the operating part 60 and/or the sealing means. The sealing means may be a component of the above-mentioned sealing means 110 or be a separate valve sealing means.

Figure 7:
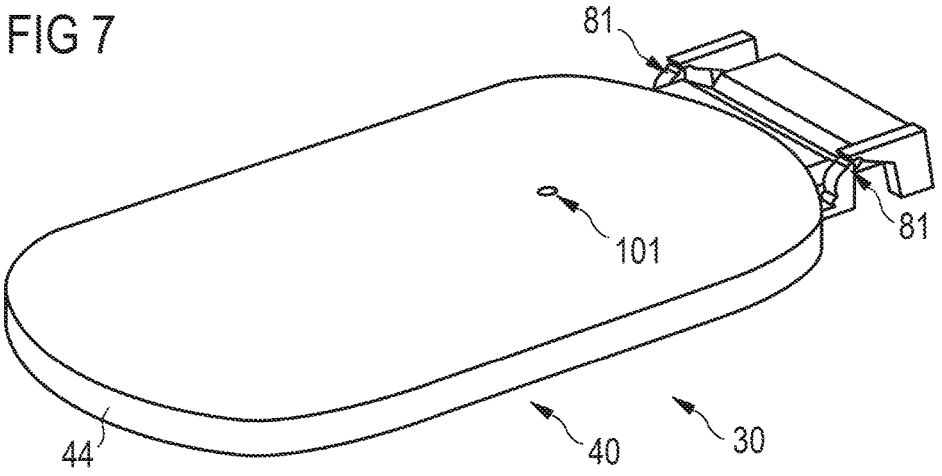
FIG. 7 is a perspective view of the bottom side of the closure part.
Figure 8:
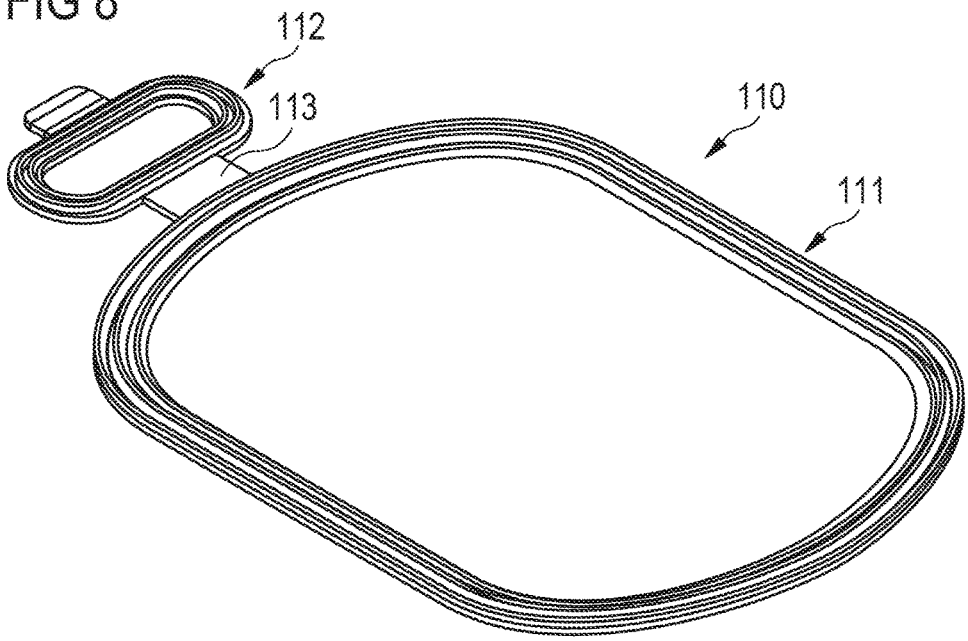
FIG. 8 is a perspective view of the sealing means.
Figure 9:
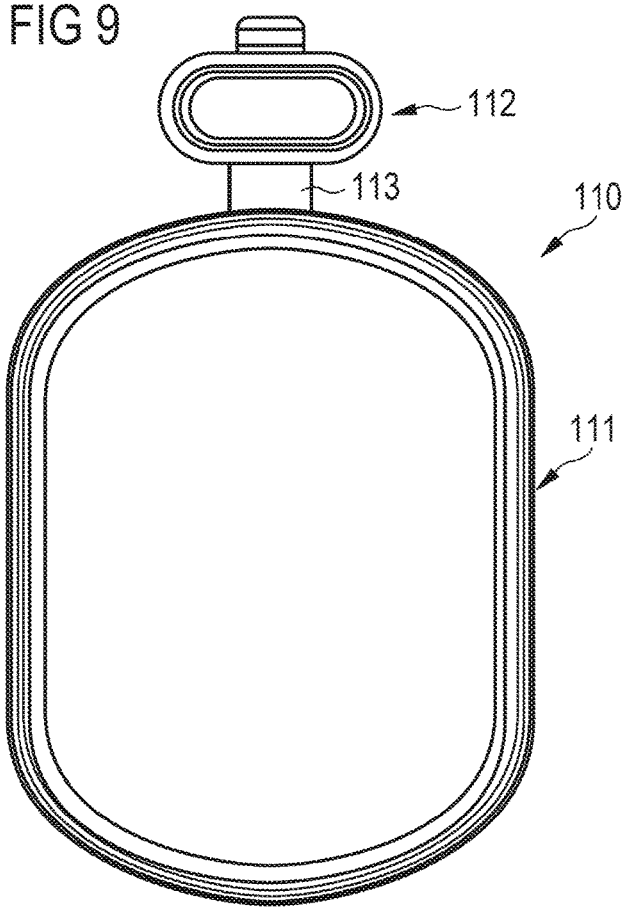
FIG. 9 is a plan view of the sealing means according to FIG. 8.
Figure 48:
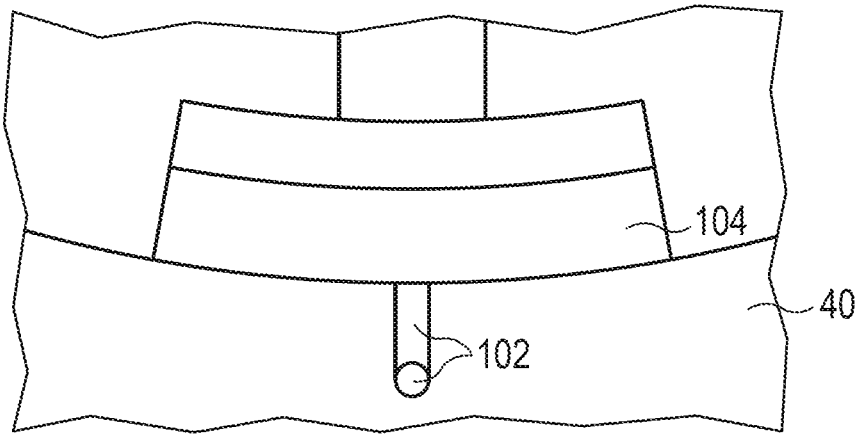
FIG. 48 shows an enlarged plan view of a valve device of the container closure device according to the invention in a closed state.
Figure 49:
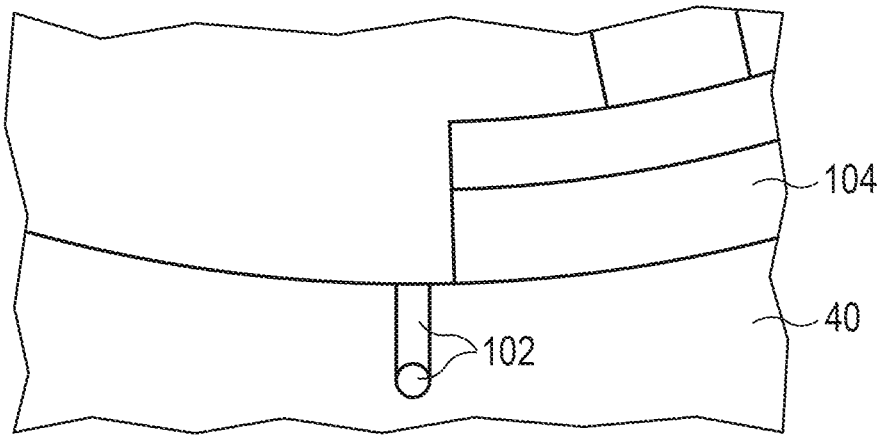
FIG. 49 shows a plan view analogous to FIG. 48 with the valve device in an opened state.
Figure 50:
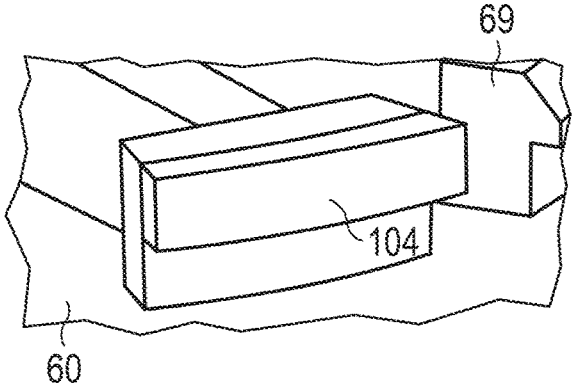
FIG. 50 shows a detail in a perspective view of a partial area of a sealing means for sealing the valve device according to FIGS. 48 and 49.
Figure 51:
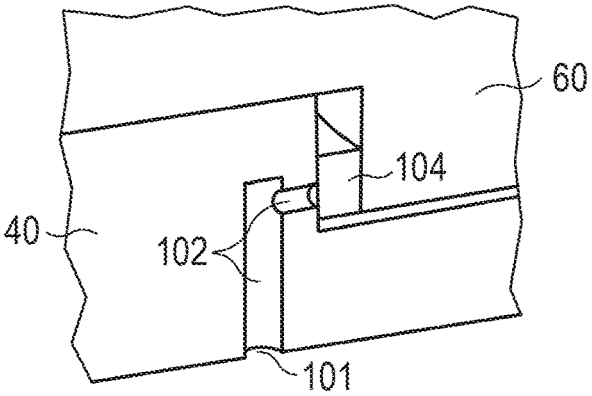
FIG. 51 shows the valve device according to the FIGS. 48 to 50 in a perspective view.
Figure 52:
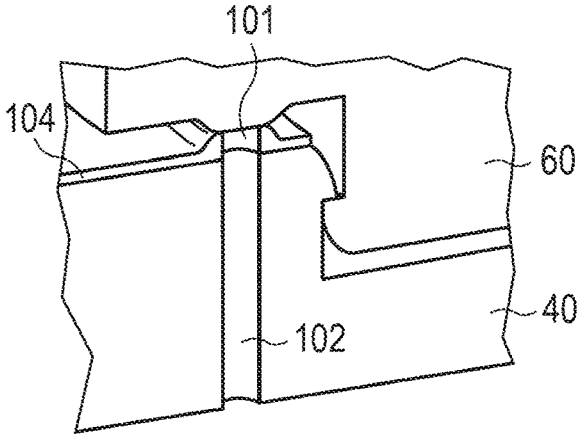
FIG. 52 shows an alternative configuration of the valve device in a perspective view.
Figure 53:
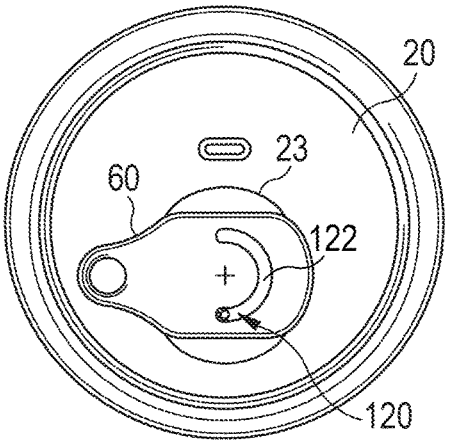
FIG. 53 is a container closure device according to the invention in a plan view in the locked position analogous to FIG. 42 with an illustration of a second embodiment of a seal device.
Figure 54:
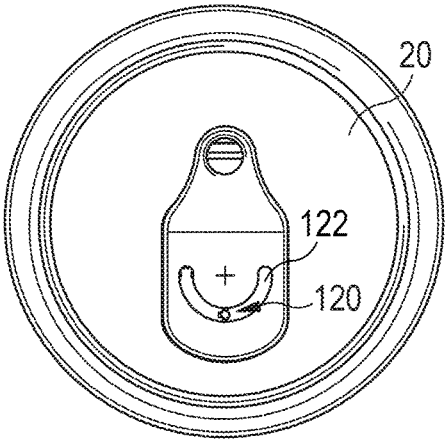
FIG. 54 is a plan view analogous to FIG. 53, but in the unlocked position and with an illustration of the seal device.
Figure 55:
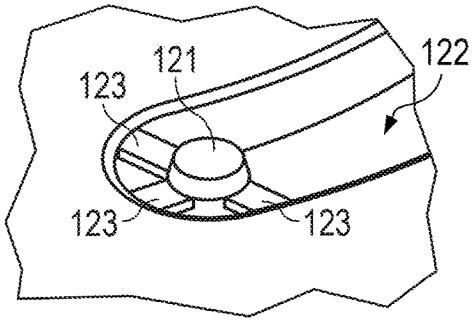
FIG. 55 shows an enlarged perspective detail of the seal device prior to the container closure device being opened for the first time.
Figure 56:
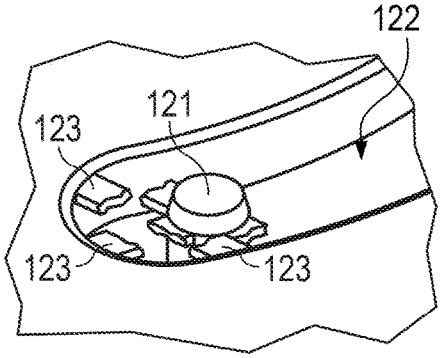
FIG. 56 shows the seal device according to FIG. 55 in a damaged state.
Figure 57:
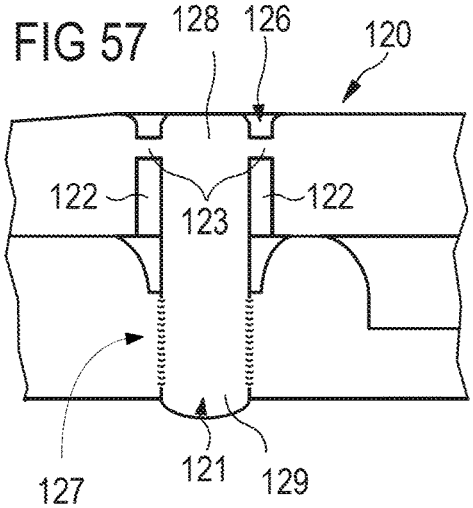
FIG. 57 shows a cross section through the seal device according to FIG. 55.
Figure 58:
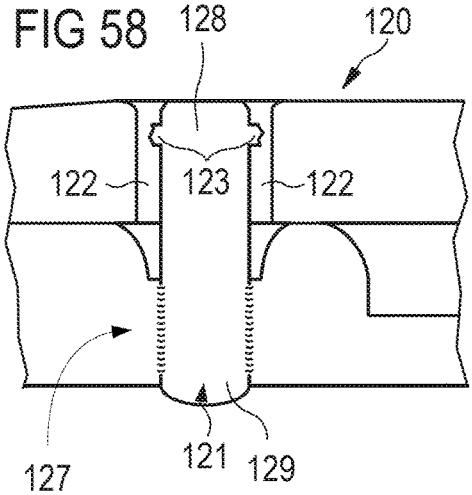
FIG. 58 shows a cross section through the damaged seal device according to FIG. 56.
Figure 59:
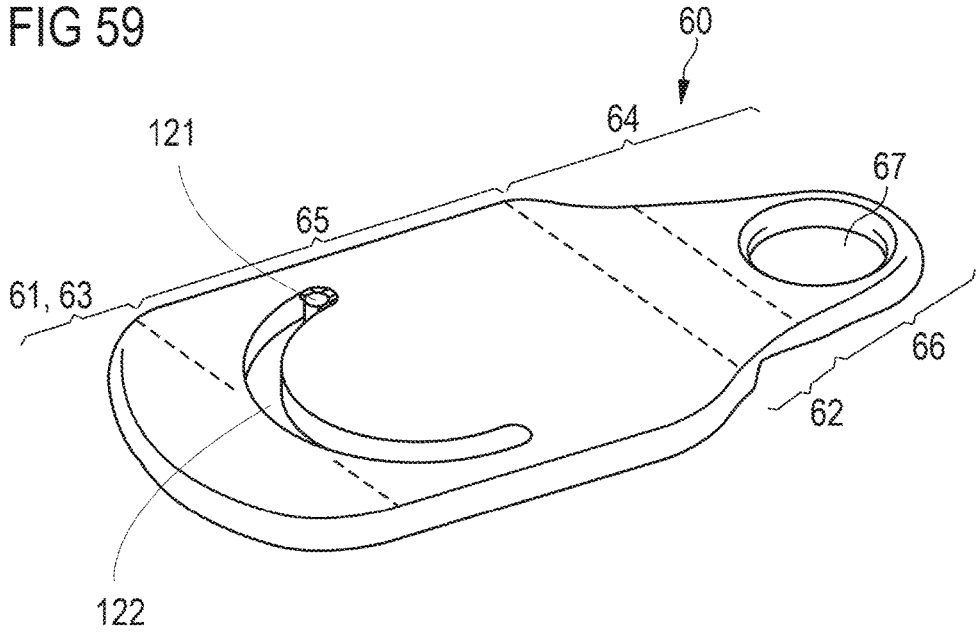
FIG. 59 is a perspective view of the top side of the operating part according to FIGS. 53 to 58.
Figure 60:
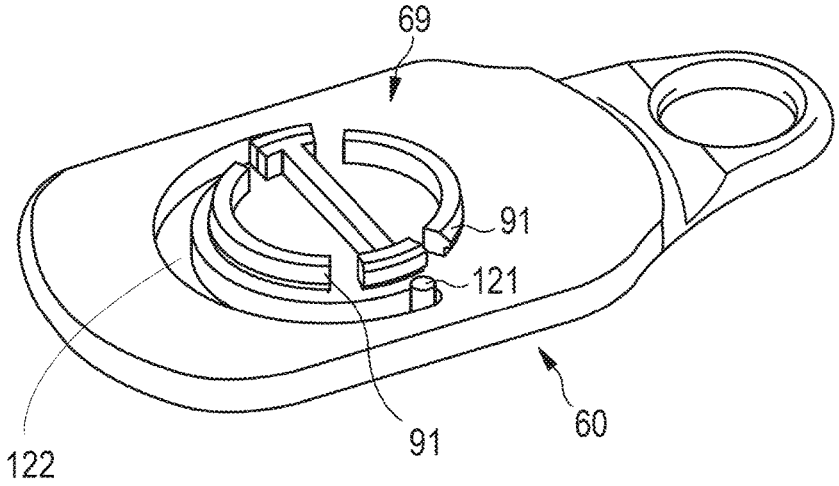
FIG. 60 is a perspective view of the bottom side of the operating part according to FIGS. 53 to 58.
Figure 61:
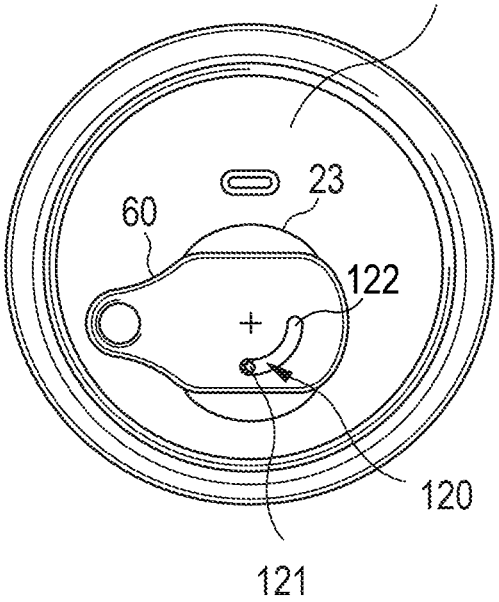
FIG. 61 is a container closure device according to the invention in a plan view in the locked position analogous to FIG. 53 with an illustration of a third embodiment of a seal device.
Figure 62:
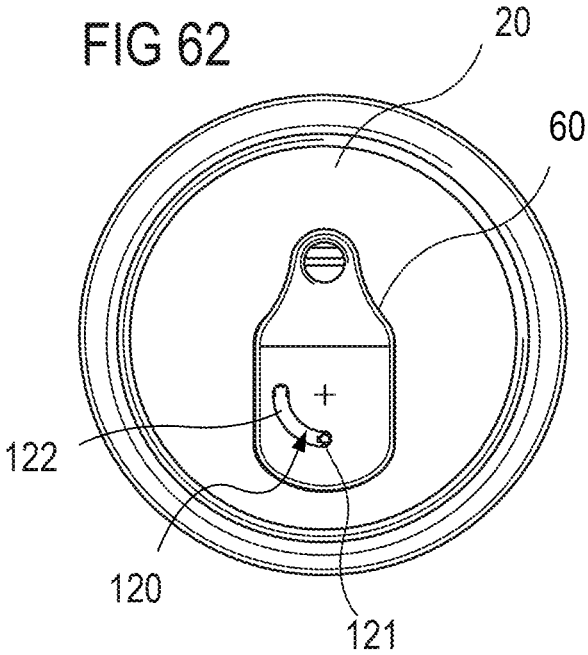
FIG. 62 is a plan view analogous to FIG. 61, but in the unlocked position and with an illustration of the seal device.
Figure 63:
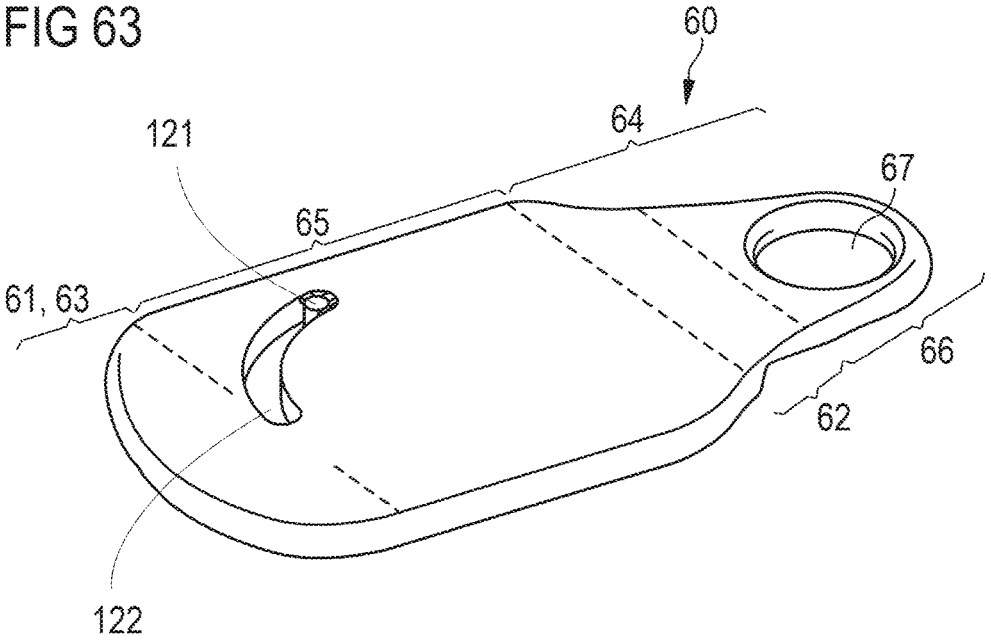
FIG. 63 is a perspective view of the top side of the operating part according to FIGS. 61 to 62.
Figure 64:
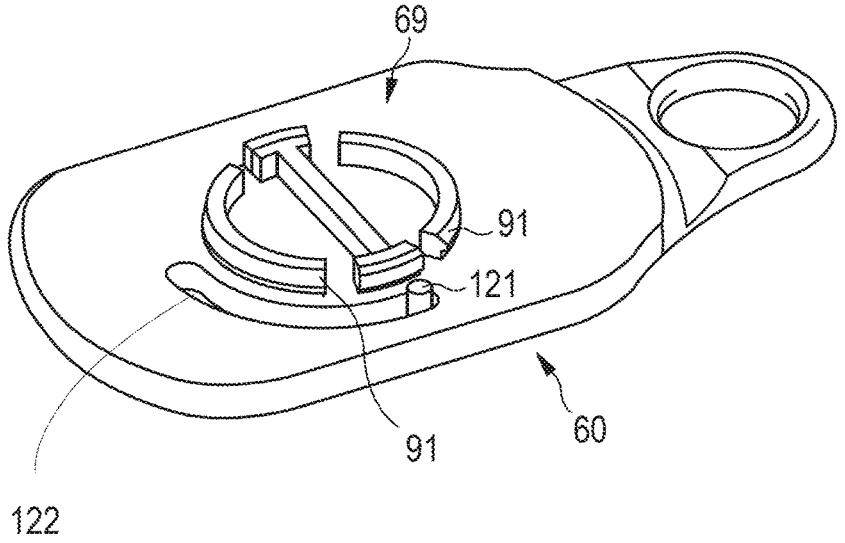
FIG. 64 is a perspective view of the bottom side of the operating part according to FIGS. 61 to 62.

The FIGS. 48 to 51 show a first variant of the valve device 100 with a valve sealing means 104. FIG. 50 shows an enlarged perspective detail of FIG. 5. The FIGS. 48 and 49 each show a horizontal section through the connection projection 69 of the operating part 60, the closure part 40, the valve passage 102 and the valve sealing means 104. FIG. 51 shows a vertical section, from which it is apparent, in particular, that the valve passage 102 has a horizontal portion and a vertical portion and opens into a valve opening 101 provided on the bottom side of the closure part 40 (FIG. 7). FIGS. 48 and 51 show the closed position of the valve device 100, in which the valve sealing means 104 seals the end of the valve passage 102. FIG. 49 shows the opened position of the valve device 100, in which the valve sealing means 104 unblocks the end of the valve passage 102. FIG. 52 shows a second variant of the valve device 100, wherein the valve sealing means 104 is provided on the top side of the closure part 40 and/or may be a component of the sealing means 110 explained further above. In this case, the sealing means and/or the bottom side of the operating part 60 can be configured with slanted surfaces in order to enable a better push-on or run-on process. FIG. 52 shows the closed position of the valve device 100, in which a projection region of the bottom side of the operating part 60 closes the valve opening 101 and/or the end of the valve passage 102.

The seal device 120 is now explained in more detail. In this respect, three embodiments of the seal device 120 will be described. When the container closure device 10 is opened for the first time, the seal device 120 is damaged in a manner that can be perceived visually and/or acoustically by the user. The first embodiment of the seal device 120 is shown in FIGS. 42 to 47, the second embodiment is shown in the FIGS. 53 to 60, and the third embodiment is shown in the FIGS. 61 to 64.

The seal device 120 according to the first embodiment (FIGS. 42 to 47) comprises a seal projection 121, a seal recess 122, at least one web 123 and an intermediate space 124. When the container closure device 10 is opened for the first time, the seal device 120 is damaged in a manner that can be perceived visually and/or acoustically by the user. The seal projection 121 is connected to the operating part 60 via two webs 123, for example, which serve as a predetermined breaking point. Here, the seal projection 121 is preferably integrally formed with the operating part 60. Preferably, the seal projection 121 is connected to the operating part 60 via one or more webs 123 as the at least one predetermined breaking point. The associated seal recess 122 is provided on or in the closure part 40. In the not-yet-damaged state prior to the first opening, the seal projection 121 protrudes into the seal recess 122. The seal projection 121 protrudes into the seal recess 122 in such a manner that it touches the closure part 40, in particular the bottom of the sealing recess 122, in the area of the free end protruding thereinto. Alternatively, a spacing between the end face of the seal projection 121 and the closure part 40 may also be provided. Furthermore, the webs 123 enable the formation of an intermediate space 124 between the seal projection 121 and the operating part 60. When the operating part 60 is rotated starting from the locking position of the operating part 60, the seal projection 121 cooperates with the seal recess 122 in such a way that at least one of the webs 123 is damaged. In the process, the seal projection 121 strikes against a wall 125 of the seal recess 122 and the predetermined breaking point is damaged, i.e. at least one of the webs 123 or all of them break, or instead of breaking, the webs are visibly deformed or expanded together with the seal projection 121, so that the latter protrudes over the upper edge of the operating part 60.

In the second embodiment (FIGS. 53 to 60), the seal device 120 comprises a seal projection 121 and a seal recess 122, wherein the seal projection 121 is connected to the operating part 60 via at least one predetermined breaking point, preferably via three webs 123. The seal recess 122 is formed in the operating part 60. The seal projection 121 is integrally formed with the operating part 60 via the at least one web 123. The seal projection 121 extends substantially perpendicularly to the operating part 60 and the closure part 40, and thus substantially parallel to the second axis. In this embodiment, the seal projection 121 is configured as a pin and comprises a first end 128 and a second end 129. However, the seal projection may also be configured with a T-shape or an L-shape (not shown for the sake of convenience). Preferably, the first end 128 is located in the area of the operating part 60 and the second end 129 in the area of the closure part 40. In other words, a first connection 126 between the seal projection 121 and the operating part 60 is provided by means of the webs 123 in the region of the first end 128, which connection is damaged when the container closure device 10 is opened for the first time. A second connection 127 between the seal projection 121 and the closure part 60 in the region of the second end 129, which is not damaged when the container closure device 10 is opened for the first time, nor later. The seal projection 121 and the seal recess 122 cooperate in such a way that the seal device 120 is damaged when the operating part is rotated for opening the container closure device for the first time. Basically, the first connection 126 and/or the second connection 127 may be configured as a substance-to-substance, non-positive and/or positive connection. In the present embodiment, the first connection 126 is integrally formed by means of the webs 123 already described above, and the second connection 127 preferably is a substance-to-substance connection, for example by means of welding (ultrasonic welding) of gluing.

As is apparent from the FIGS. 53 to 60, the seal recess 122 is configured as an elongated hole, wherein the elongated hole is configured as a through-hole, i.e., it extends over the entire component thickness of the operating part 60. The seal recess 122 is configured with an arcuate shape, preferably semicircular (see FIGS. 53, 54, 59, 60). In this case, the center of the circle is preferably located on the second axis. Thus, the cooperation of the seal projection 121 and the seal recess 122 is able to support the repeated rotary movements for re-opening and re-closing, even after the first opening.

As is apparent in particular from the FIGS. 55 to 58, the seal projection 121, in an end region of the seal recess 122 configured as an elongated hole, is integrally connected to the operating part 60 via several webs 123, wherein the seal projection 121 extends substantially perpendicularly relative to the operating part 60.

Because of this configuration, when rotating the operating part 60, the operating part 60 can be moved along the seal recess 122 (preferably in the form of the elongated hole) relative to the seal projection 121 subsequent to a first opening by rotating the operating part 60, after the webs 123 have been broken (see FIG. 56), i.e. after disconnecting the first connection 126. The closure part 40 remains in its position when the operating part is rotated 60, i.e. it does not rotate, whereby the operating part 60 is guided along the stationary seal projection 121 by means of its seal recess 122.

With the exception of the shape of the seal recess 122, the seal device 120 according to the third embodiment (FIGS. 61 to 64) corresponds to the above-described second embodiment. Thus, FIGS. 55 to 58 analogously apply also to the third embodiment. In contrast to the semicircular configuration of the second embodiment, the seal recess 122 configured as an elongated hole is configured as a quarter circle in the present third embodiment (see FIGS. 61 to 64). In other regards, reference is made to the explanations pertaining to the second embodiment.

Figure 37:
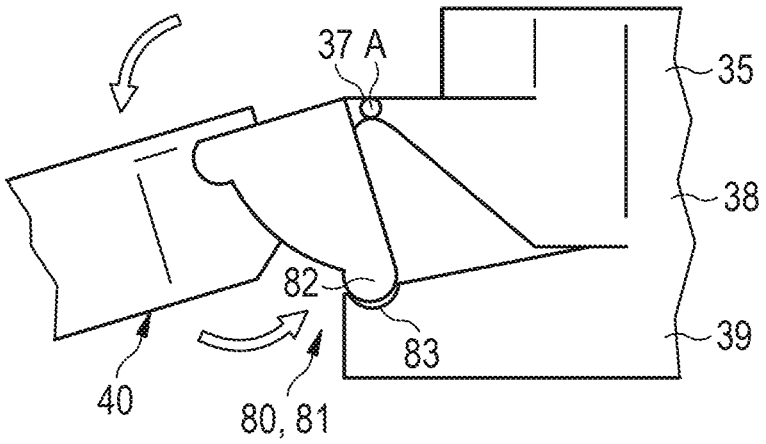
FIG. 37 is an enlarged portion of the fixing device from FIGS. 33 to 35 in a fixed position.

Further, the closure unit 30 comprises a fixing device 80 by means of which, in a fixed position, the closure part 40 can be detachably fixed in the open position and by means of which, in a released position, the closure part 40 can be pivoted between the closed position and the open position. For a further explanation of the fixing device 80, reference is made, in particular, to the FIGS. 16, 17 and 33 to 47. Here, FIGS. 16 and 17 as well as 31 and 32 each show the released position of the fixing device, in which the closure part 40 can be pivoted between the closed position and the open position. FIG. 37 shows the fixed position of the fixing device 80.

In a preferred embodiment, the fixing device 80 is configured as a latching device 81. For stability reasons, two latching devices 81 are preferably provided which are positioned symmetrically to a longitudinal axis of the closure part 40 (see, in particular, FIGS. 6 and 7). These two latching devices 81 are preferably disposed in the end regions or at the ends of the first axis A. The latching device 81 has a first latching member 82 in the form of a latching cam (or latching projection) and a second latching member 83 in the form of a latching receptacle (or latching recess). One of the latching members 82, 83 is provided or integrally formed on the closure region 31 of the closure part 40, and the other one of the latching members 82, 83 on an attachment region 32 of the closure part 40. As is apparent from the FIGS. 33 to 37, the latching cam 82 can be configured in a curvilinear or curved manner, for example, in the area of its free end. Alternatively, a shape extending linearly or obliquely in some portions, or combinations thereof, may be chosen. Accordingly, the latching receptacle 83 is substantially shaped in such a way that, when the closure part 40 is pivoted about the first axis A into the interior of the container, the two latching members 82 and 83 can come into engagement with each other in order to maintain the fixed position. Accordingly, the two latching members 82, 83 can come out of engagement when the closure part 40 is pivoted back about the first axis A, in order to maintain the released position and make it possible to close the container opening 23. Preferably, the first latching member 82 and/or the second latching member 83 is configured to be at least partially (bendably) elastic. The return pivoting action can be obtained by pressing the second end region 64 or the grip portion 66.

Referring to FIGS. 38 to 41, an alternative embodiment of the fixing device 80 is described below. For this purpose, the fixing device 80 is configured as a latching device 81.

In turn, the latching device has a first latching member and a second latching member, wherein at least one of them is configured to be at least partially elastic, and wherein one of the latching members is provided on a closure region 31 of the closure part 40 serving for closing the container opening, and the other latching member is provided on an attachment region 32 of the closure part 40 serving for attaching the closure unit to the inner face of the container wall.

The latching member disposed on the attachment region 32 is preferably configured as a latching cam 88 (or latching projection). Preferably, the latching cam 88 is integrally formed with the closure part 40 and is attached thereto on the bottom side and to the attachment region 32 of the closure part. Also preferably, the latching cam 88 can be provided with latching webs or latching nubs, which make it possible to retain or reach behind the other latching member in a frictional and/or non-positive manner.

The other latching member disposed on the closure region 31 is preferably configured as a latching flange 85 (or latching recess). Preferably, the latching flange 85 is integrally formed with the closure part 40. The latching flange 85 may have a first flange portion 86 and a second flange portion 87. Preferably, the latching member is configured as a hook-shaped or L-shaped flange (seen in cross section). In this case, the one end of the flange is attached to closure region 31 of the closure part 40, and the other end of the flange 85 is formed as a free end which can cooperate with the other latching member 88 in the fixed position of the fixing device.

The two flange portions 86, 87 of the flange 85 may extend substantially perpendicularly relative to each other or at a predetermined angel relative to each other. In particular, the free end of the flange portion 87 may be configured to be elastically bendable in order to come into contact with the other latching member 88 by bending and/or pressing the free end, so that the fixed position of the closure region 31 of the closure part 40 can be maintained.

Figure 38:
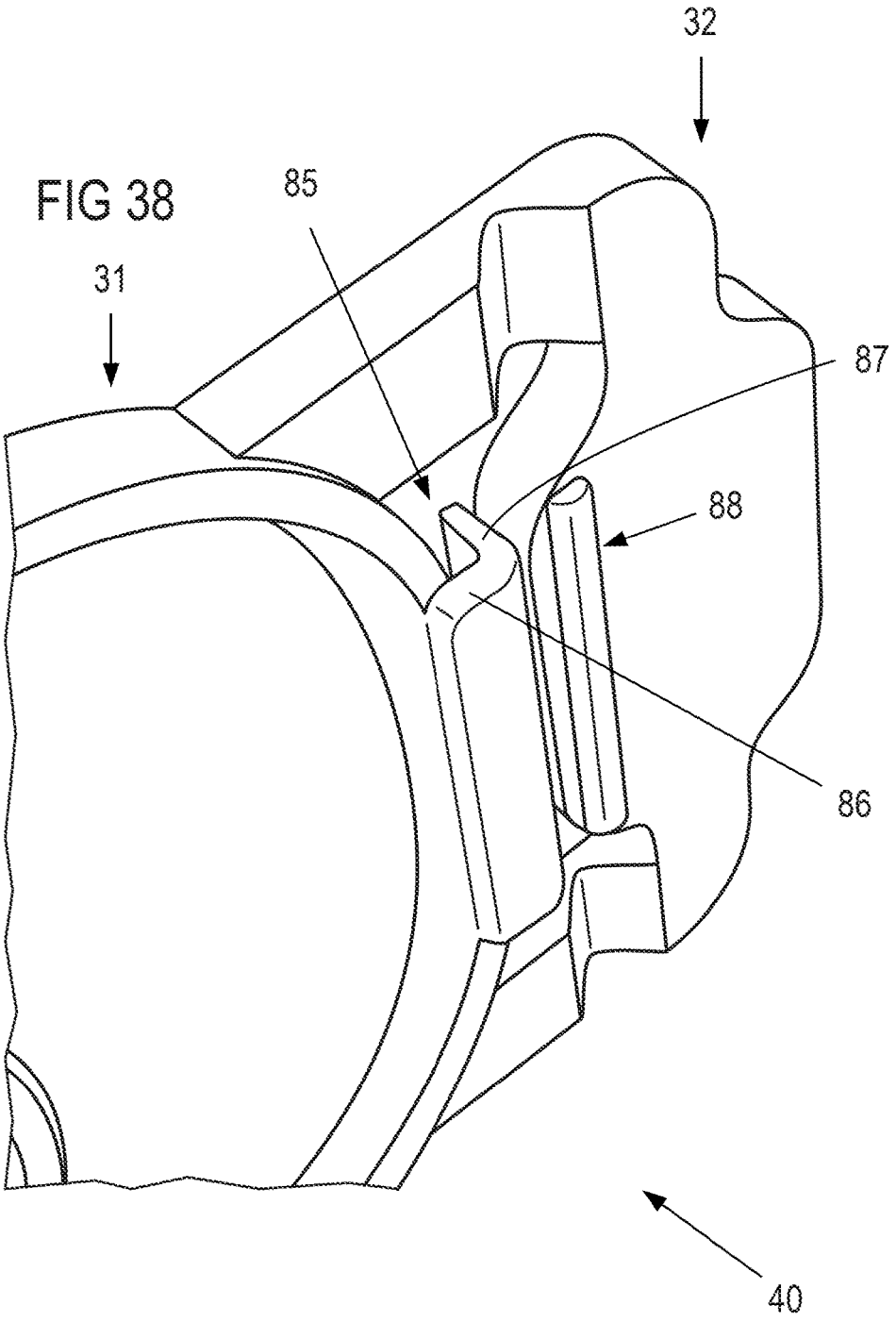
FIG. 38 is a schematic perspective view obliquely from below, with another embodiment of a fixing device in the released position.
Figure 39:
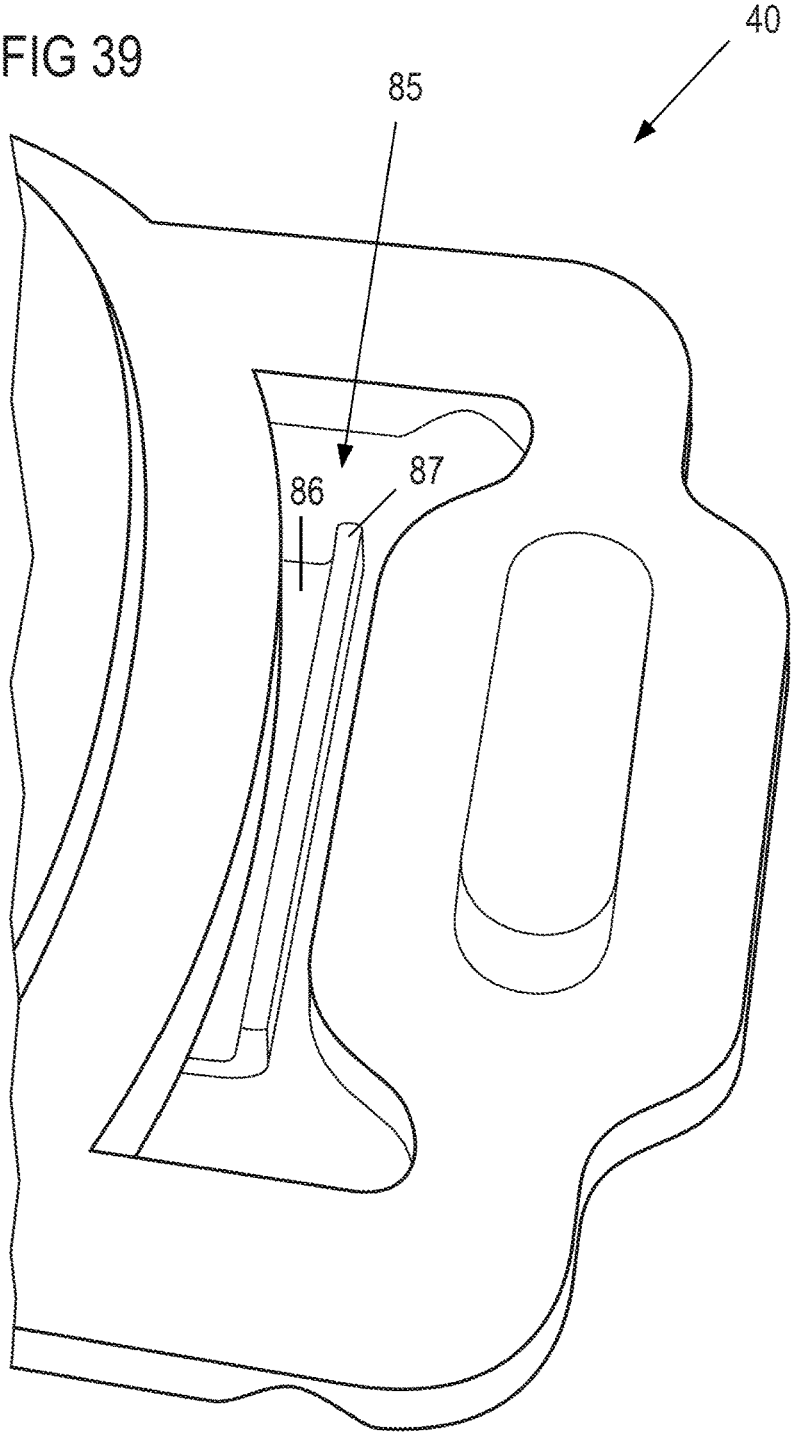
FIG. 39 is a schematic perspective view obliquely from above of the embodiment in the released position shown in FIG. 38.
Figure 40:
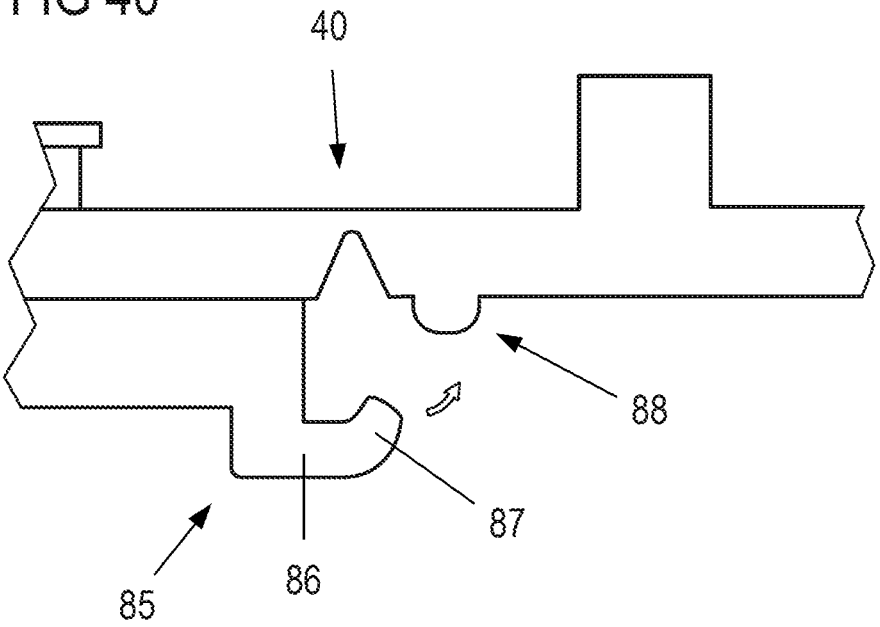
FIG. 40 is a schematic partial section of the fixing device according to FIGS. 38, 39 in the released position.
Figure 41:
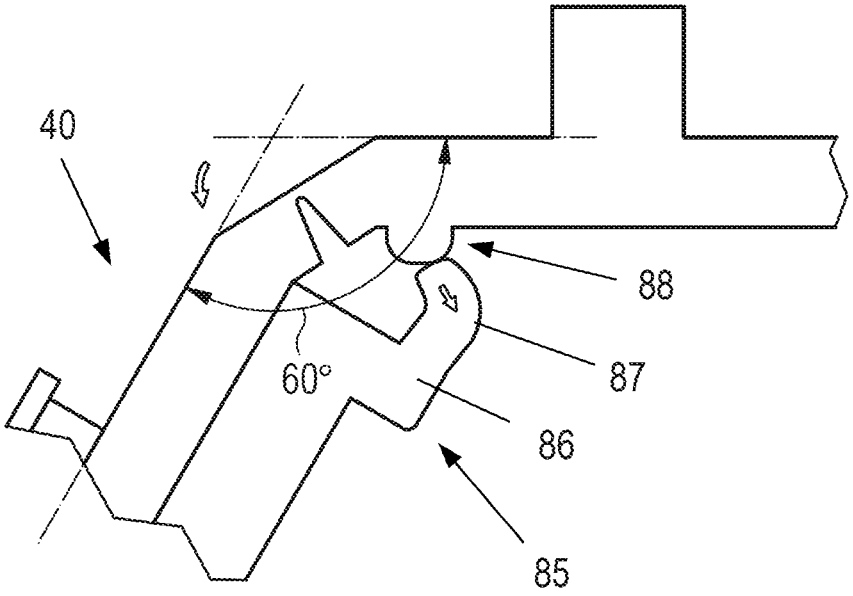
FIG. 41 is a schematic partial section of the fixing device according to FIGS. 38, 39 in the fixed position.
Figure 42:
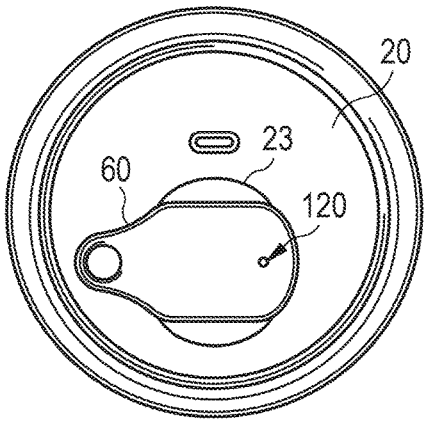
FIG. 42 is a container closure device according to the invention in a plan view in the locked position analogous to FIG. 10 with an illustration of a first embodiment of a seal device.
Figure 43:
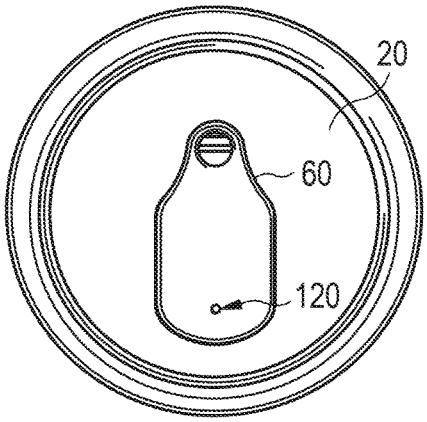
FIG. 43 is a plan view analogous to FIG. 42, but in the unlocked position and with an illustration of the seal device.
Figure 44:
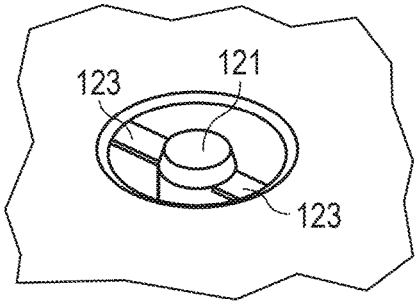
FIG. 44 shows an enlarged perspective detail of the seal device prior to the container closure device being opened for the first time.
Figure 45:
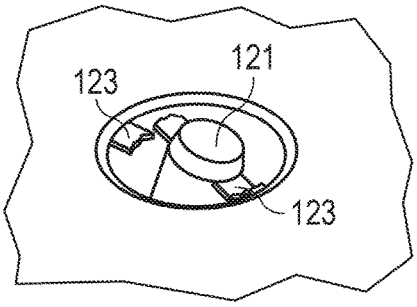
FIG. 45 shows the seal device according to FIG. 44 in a damaged state.
Figure 46:
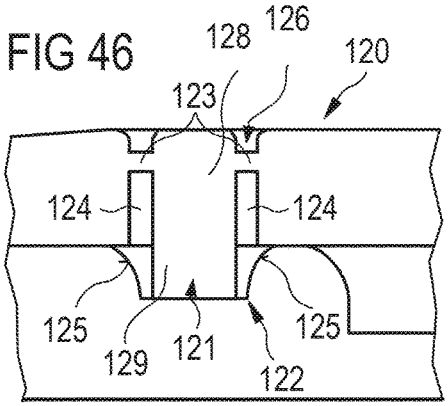
FIG. 46 shows a cross section through the seal device according to FIG. 44.
Figure 47:
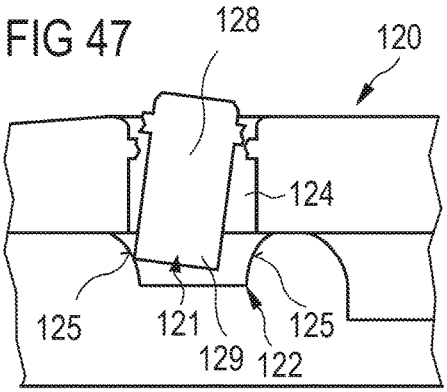
FIG. 47 shows a cross section through the damaged seal device according to FIG. 45.

As is apparent from FIG. 38, the latching cam 88 can be configured in a curvilinear or curved manner, for example, in the area of its free end. Alternatively, a shape extending linearly or obliquely in some portions, or combinations thereof, may be chosen.

Accordingly, the latching flange 85 is substantially shaped in such a way that, when the closure region 31 of the closure part 40 is pivoted about the first axis A into the interior of the container, the two latching members 85 (or 87) and 88 can come into engagement with each other in order to maintain the fixed position.

Thus, the two latching members 85 (or 87), 88 can come out of engagement when the closure region 31 of the closure part 40 is pivoted back about the first axis A, in order to maintain the released position and make it possible to close the container opening 23. Preferably, the first latching member 85 and/or the second latching member 88 is configured to be at least partially (bendably) elastic. The return pivoting action can be supported by pressing the second end region 64 or the grip portion 66.

As was already explained above with reference to the FIGS. 33 to 37, the latching members are spaced apart in the released position of the fixing device also in the FIGS. 38 to 41. In the fixed position, the latching members are connected to each other or in engagement with each other positively, frictionally or non-positively.

Alternatively, two of the previously described latching devices may also be provided, which are disposed on the closure part 40 and spaced apart. Preferably, these two latching devices are positioned symmetrically to a longitudinal axis of the closure part 40.

Furthermore, the container closure device 10 according to the invention comprises a displacement mechanism 70 (see FIGS. 24 to 32) with which (by rotating the operating part 60 relative to the closure part 40) the closure part 40 or the operating part 60 can be moved towards or moved away from the container wall 20 in a direction substantially extending perpendicularly to the container wall 20. In case of a movement in the direction towards the container wall 20, the operating part 60 and/or the closure part 40 is pressed against the container wall 20. Conversely, the operating part 60 and/or the closure part 40 is detached from the container wall 20 in the case of a movement in the direction away from the container wall 20.

The displacement mechanism 70 comprises at least one displacement means 71 which may be provided on the container wall 20, on the operating part 60 and/or on the closure part 40.

Figure 24:
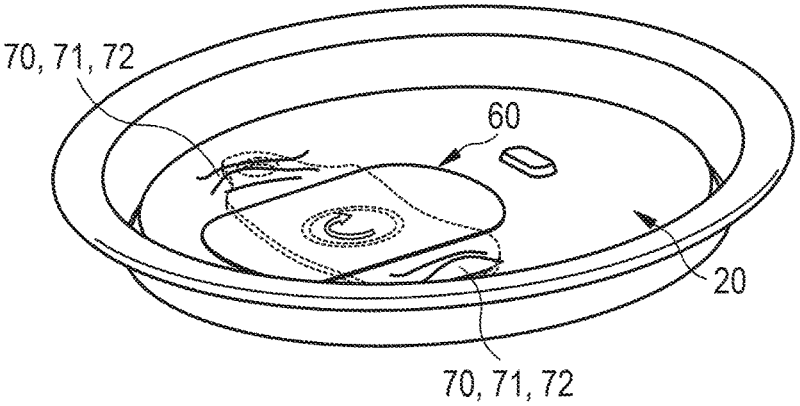
FIG. 24 is a perspective view of a container closure device according to the invention with a displacement mechanism in a first variant.
Figure 25:
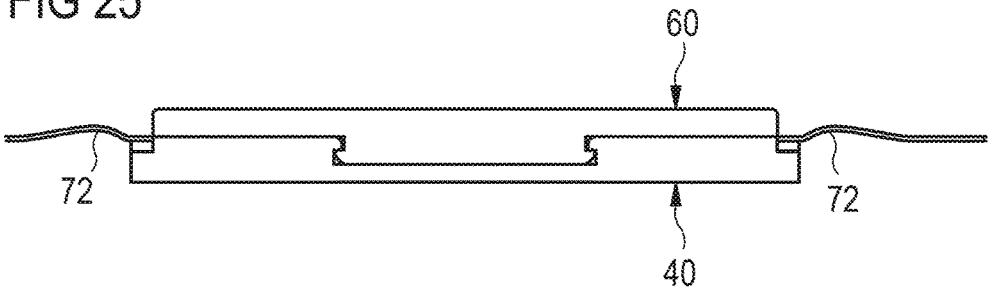
FIG. 25 is a sectional view through the illustration according to FIG. 24.
Figure 26:
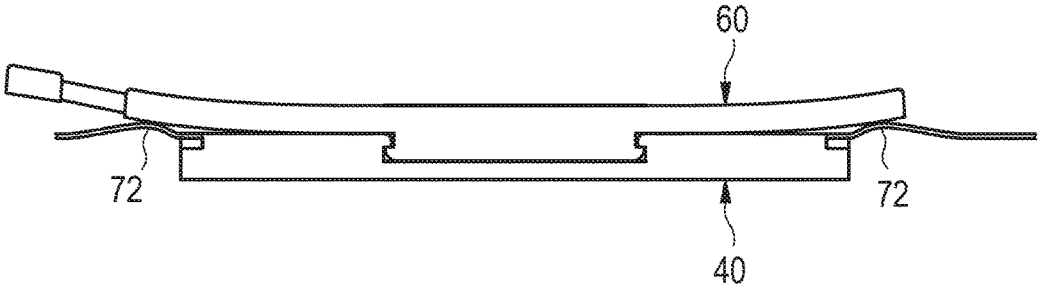
FIG. 26 is a sectional view similar to FIG. 25, wherein the operating part is in the locked position and the displacement mechanism is in a secured position.

In a first variant, the displacement means 71 is formed on the container wall 20, as is apparent from FIGS. 24 to 26. Here, the displacement means 71 is formed as a projection 72 or raised portion of the container wall 20. In this respect, FIG. 25 shows in a cross section the unlocked position shown in a perspective view in FIG. 24. Starting from here, the operating part 60 is transferred into the locked position shown in FIG. 26 by rotating the operating part 60 about the second axis B, i.e. about an axis extending perpendicularly to the container wall 20. Shortly before the locked position is reached, the one end of the operating part 60 runs up on the projection 72 until the locked position has been reached, in which the operating part 60 rests on the highest point of the projection 72. Between the start of the running-up process and reaching the highest point of the projection 72, the closure part 40 abutting against the bottom side of the opening limiting region 24 is moved towards the container wall 20 in a direction perpendicular to the container wall 20. It is thus accomplished that the closure part 40 is pressed against the container wall 20 and/or that the operating part 60 and the closure part 40 mutually press against each other. In the process, the sealing means 110 is compressed. In the case of the reverse rotary movement, the operating part 60, starting from the position in FIG. 26, is rotated back into the position according to the FIG. 24 or 25, whereby the pressing action or the squeezing action of the operating part 60 and the closure part 40, or between the closure part 40 and the container wall 20, is canceled again. Thus, the closure part 40, in particular, is in this case moved away from the container wall 20 in a direction perpendicular thereto.

Figure 27:
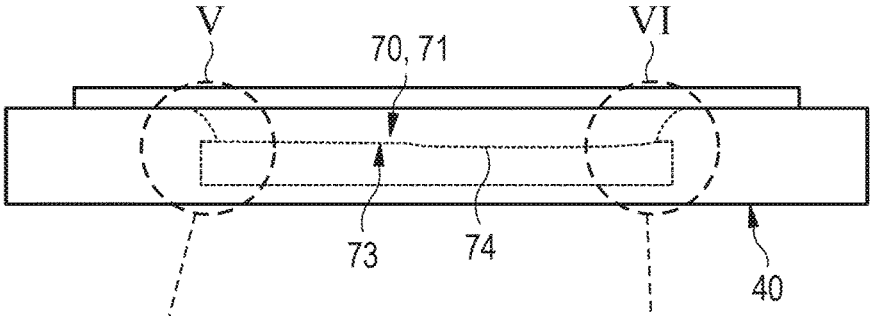
FIG. 27 is a schematic partial illustration of a container closure device according to the invention with a displacement mechanism in a second variant.
Figure 28:
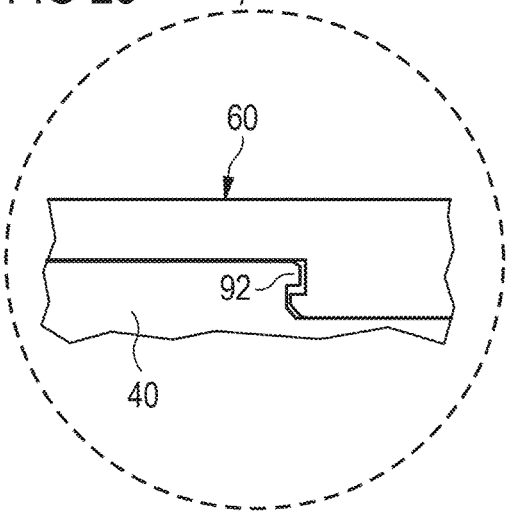
FIG. 28 shows in an enlarged illustration portions of the detail V from FIG. 27.
Figure 29:
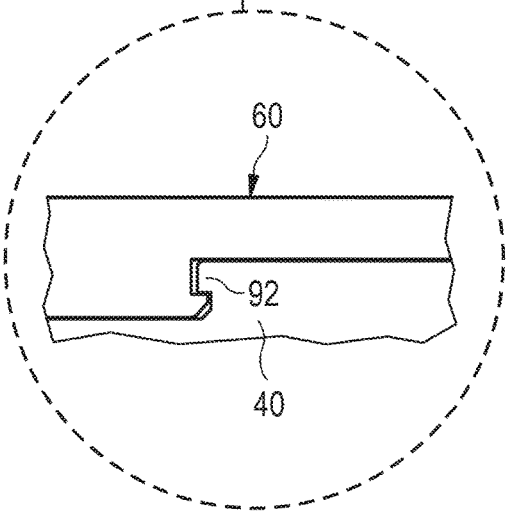
FIG. 29 shows an enlarged illustration of the detail V from FIG. 27.

In an alternative embodiment according to the FIGS. 27 to 29, the displacement means 71 is provided on the closure part 40, in particular on the connection projection 69. In this case, the displacement means 71 is configured as a control portion 73 shaped so that the control portion 73 causes a control of the movement of the closure part 40 or the operating part 60 towards the container wall 20 or away from the container wall 20. As is apparent from FIG. 27, the control portion 73 is preferably formed by an edge 74 formed on the inner circumference of the closure part 40. The edge may also be referred to as a run-up edge or run-up inclination.

In analogy to the FIGS. 27 to 29, FIGS. 30 to 32 also show such an edge 74 on the connection projection 69 of the closure part 40'. However, according to FIG. 19, it is provided in this case that the operating part 60' has a connection receptacle 43, and the closure part 40' has a connection projection 69, for rotatably connection the operating part 60' and the closure part 40'. However, it also possible that such an edge 74 is not disposed on the closure part, but on the connection projection 69 of the operating part, or simultaneously on the closure part 40 and on the operating part 60.

Second Embodiment

In a second embodiment, the container closure device according to the invention comprises the configuration according to the first aspect of the present invention described above. Thus, the configuration of the second and third aspects is not included. In other words, this container closure device according to the invention comprises the locking portions 61, 62, but not the displacement mechanism 70, and not the fixing device 80. One or more of the preferred configurations defined in the claims may also be included.

Third Embodiment

In a third embodiment, the container closure device according to the invention comprises the configuration according to the second aspect of the present invention described above. Thus, the configuration of the first and third aspects is not included. In other words, this container closure device according to the invention comprises the displacement mechanism 70, but not the locking portions 61, 62, and not the fixing device 80. One or more of the preferred configurations defined in the claims may also be included.

Fourth Embodiment

In a fourth embodiment, the container closure device according to the invention comprises the configuration according to the third aspect of the present invention described above. Thus, the configuration of the first and second aspects is not included. In other words, this container closure device according to the invention comprises the fixing device 80, but not the locking portions 61, 62, and not the displacement mechanism 70. One or more of the preferred configurations defined in the claims may also be included.

Other Embodiments

In other embodiments, the container closure device according to the invention comprises the configuration according to two of the three aspects of the present invention described above. This may include a combination of the first with the second, or a combination of the first with the third aspect, or a combination of the second with the third aspect.

Figure 65:
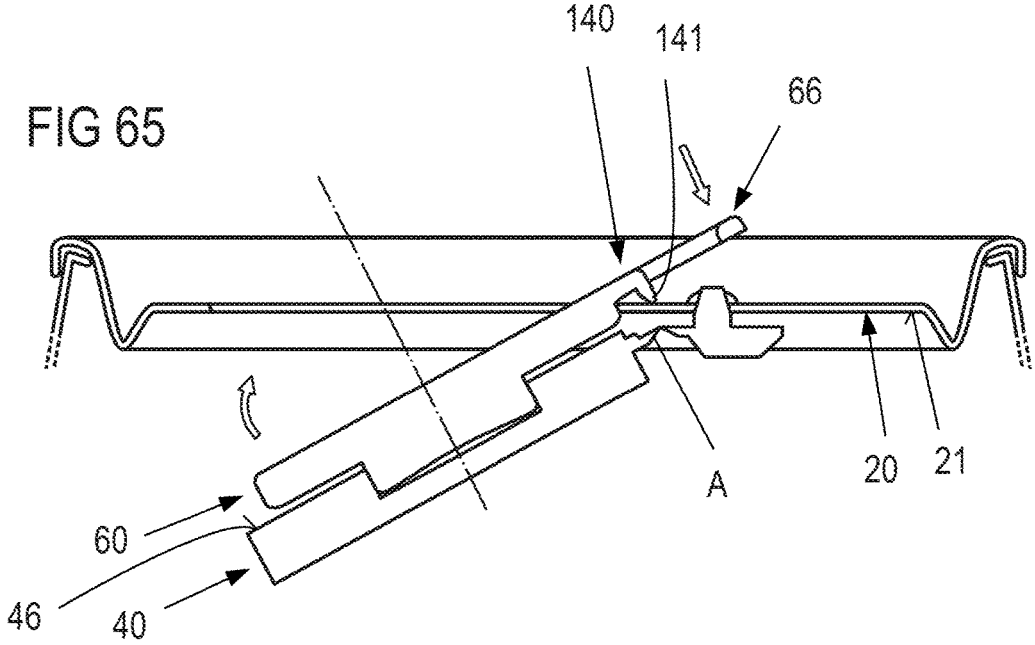
FIG. 65 is a schematic cross section through an assembled container closure device of the invention according to FIG. 15, wherein the closure part is provided with a lever support device and the closure part is in the open position.
Figure 66:
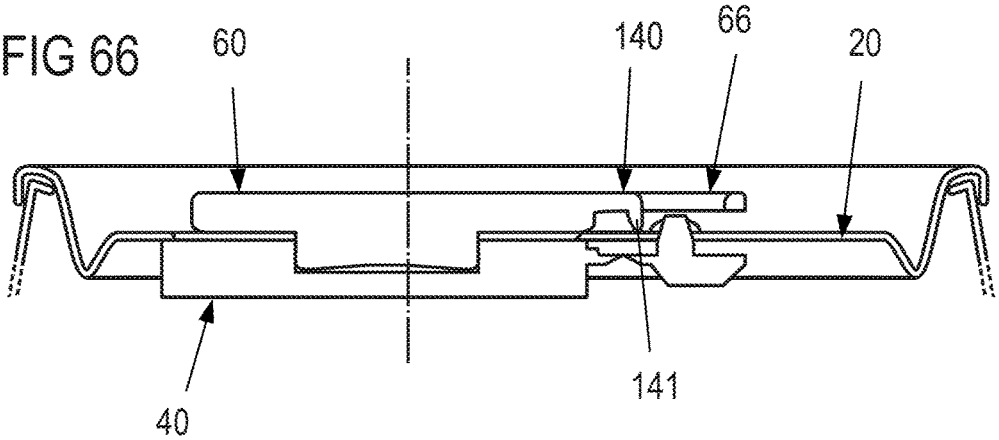
FIG. 66 is a schematic cross section analogous to FIG. 65, wherein the closure part is in the closed position.

Other Modifications:

Referring to FIGS. 65 to 72, one or more of the following modifications may be provided in other embodiments of the container closure device according to the invention:

In a preferred embodiment according to FIGS. 65 and 66, a lever support device 140 is provided, which, during the pivoting movement of the closure part 40 from the open position into the closed position, enables a leverage effect in such a way that the pivoting movement of the closure region 31 of the closure part 40 towards the inner face 21 of the container wall 20 is supported up to the closed position of the closure part 40. Thus, the lower edge (bottom side) of the operating part 60 can be brought up above the container wall 20 by pressing downwards onto the end of the operation part 60 (particularly in the area of the grip portion 66), in order to then enable the rotary movement of the operating part 60 relative to the closure part 40. At the same time, the top side 46 of the closure part 40 and a sealing means, which may be disposed there if necessary, can be brought to rest or pressed against the inner face (bottom side) 21 of the container wall 20.

As shown in FIGS. 65, 66, the lever support device 140 comprises a support member in the form of a flange 141, which is disposed or formed on the operating part 60 and is preferably integrally formed with the operating part 60. Preferably, the flange 141 extends substantially perpendicularly to the extension plane of the operating part 60 and protrudes downwards from the operating part 60. Alternatively (not shown), the flange 141 extends at a predetermined angle to the extension plane of the operating part 60, e.g. in a range of 10° to 80°, in particular in a range of 30° to 60°.

Figure 67:
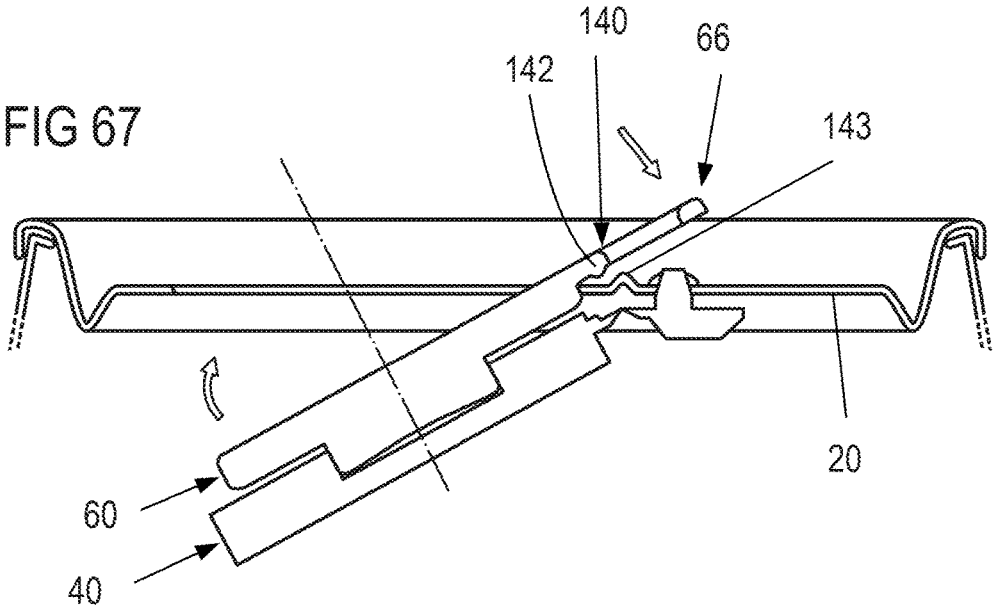
FIG. 67 is a schematic cross section through a container closure device according to FIGS. 65, 66, wherein both the closure part and the container wall are provided with a lever support device and the closure part is in the open position.
Figure 68:
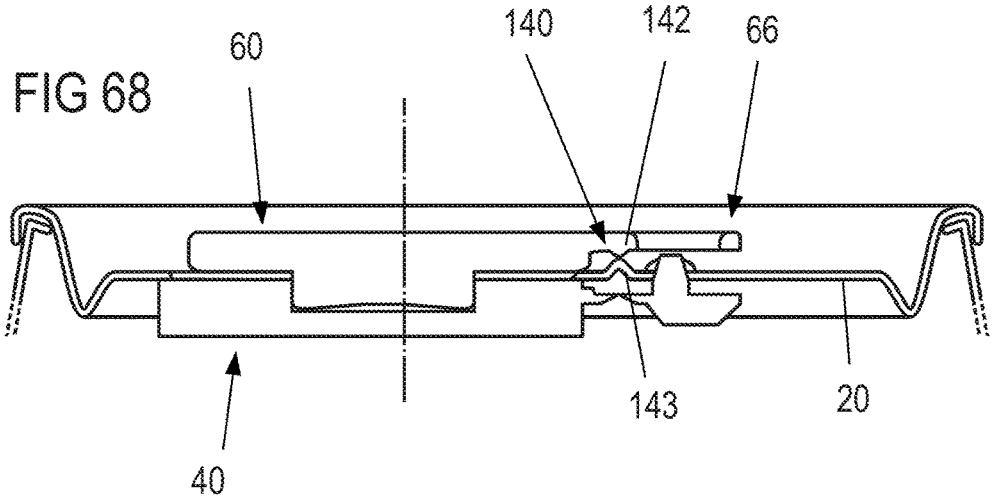
FIG. 68 is a schematic cross section analogous to FIG. 67, wherein the closure part is in the closed position.

In the configuration shown in the FIGS. 67 and 68, the lever support device 140 comprises a first support member in the form of a projection 142 which is disposed or formed on the operating part 60 and protrudes downwards, and a second support member in the form of a projection 143 which is disposed on the container wall 20 and protrudes upwards. The projection 142 is preferably integrally formed with the operating part 60, and the projection 143 preferably is an integral component of the container wall 20. The projection 143 may be configured as an embossing in the container wall 20 and be formed, for example, in a V-shape.

The support members 142 and 143 are disposed opposite from each other and, further, are dimensioned and oriented relative to one another in such a way that they cooperate in such a way, over the course of the pivoting movement of the closure part 40 from the open position into the closed position, that the leverage effect on the closure region 31 of the closure part 40 can be obtained.

The fact that the projection 142 protrudes downwards in the direction of the container wall 20 and the projection 143 protrudes upwards in the direction of the operating part makes it possible for the two support members 142, 143 to come into contact with each other in the area of the final path of movement during the pivoting movement of the closure region 31 of the closure part 40 from the open position into the closed position, so that the leverage effect can be obtained.

The support members 141 and 142, which are shown in the FIGS. 65 to 68 and disposed on the operating part 60, are arranged in the area of the locking portion 22 and/or of the grip portion 66 of the operating part 60, so that the support member 141 and 142 is situated adjacent to the first axis A.

Figure 69:
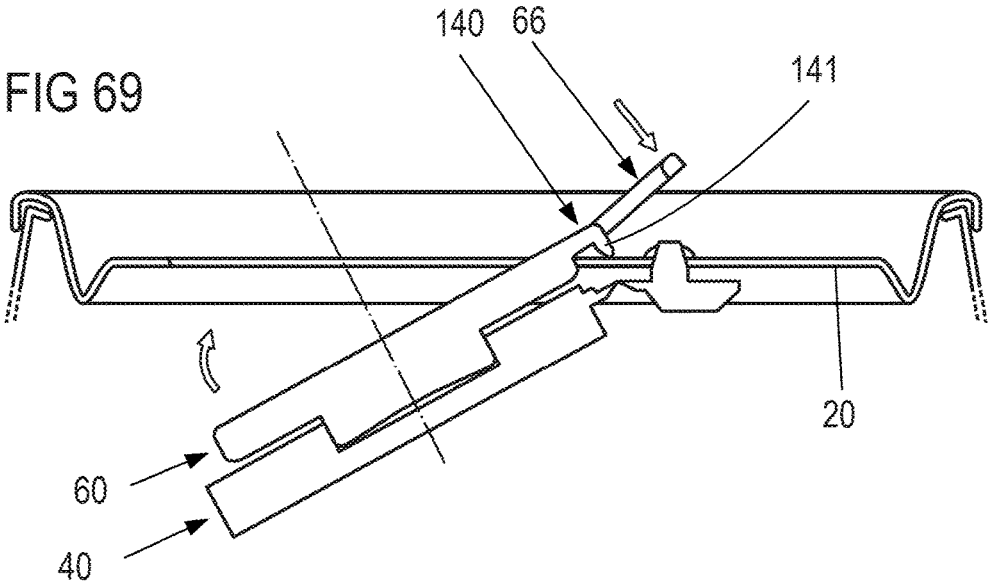
FIG. 69 is a schematic cross section through a container closure device similar to FIG. 65, wherein the closure part is provided with the lever support device according to FIG. 65 and the grip portion of the operating part extends in an angled manner, and wherein the closure part is in the open position.
Figure 70:
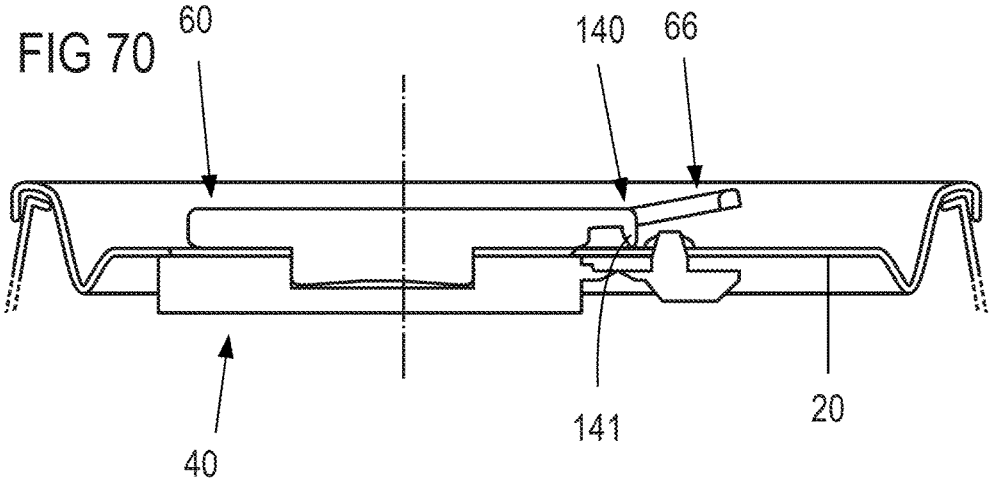
FIG. 70 is a schematic cross section analogous to FIG. 69, wherein the closure part is in the closed position.

In the configuration shown in FIGS. 69 and 70, the grip portion 66 of the end region of the operating part 60 extends in an angled or curved manner relative to the extension plane of the operating part 60. A leverage effect can thus be generated, because a greater lever arm and/or a greater distance of the end of the grip portion from the container wall is provided. In this configuration, the lever support device is not necessary but may be additionally provided.

Figure 71:
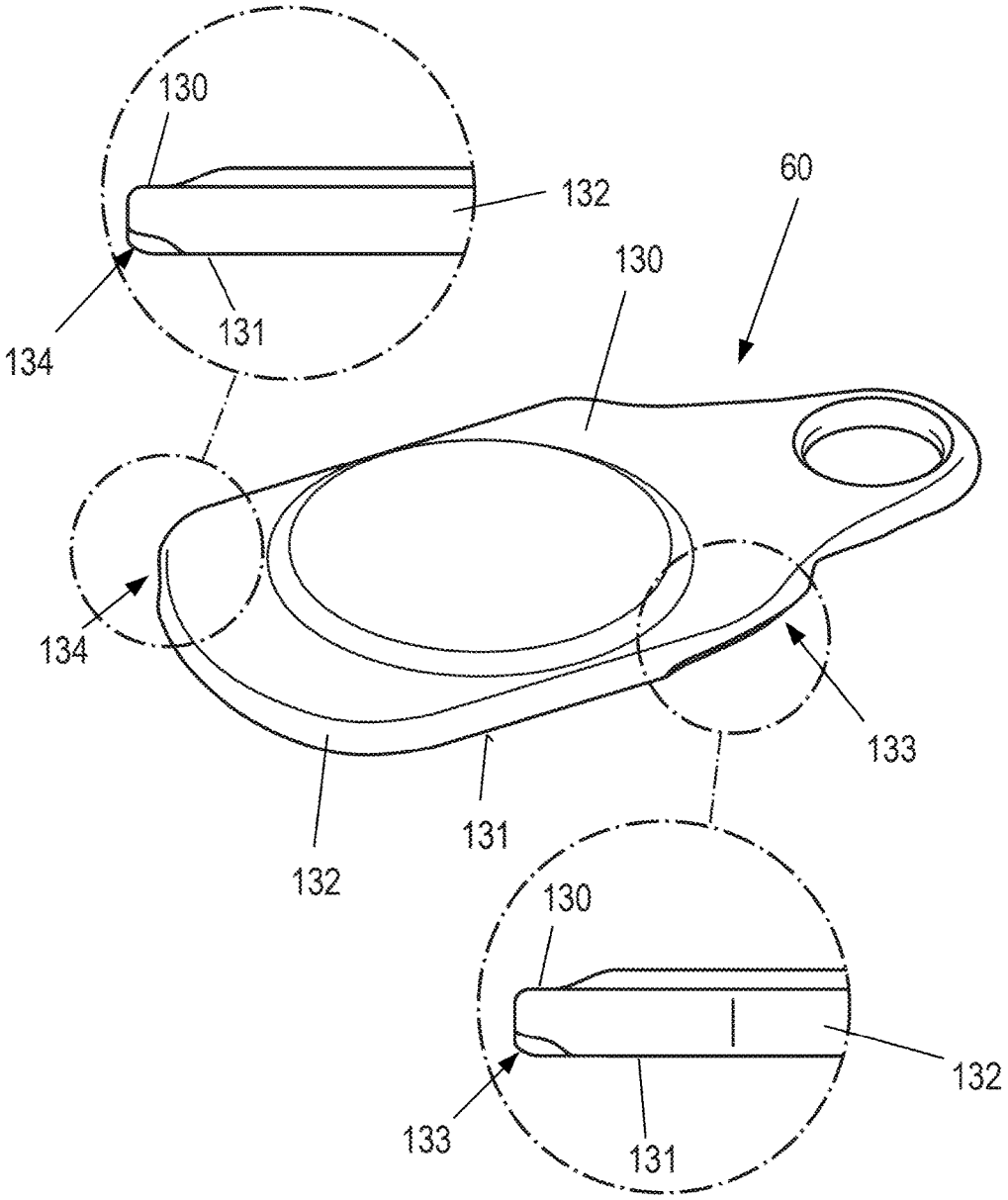
FIG. 71 is a perspective view of an embodiment of the operating part of the container closure device according to the invention with slanted side edge portions as run-up surfaces.

In the configuration shown in FIG. 71, the operating part 60 has a top side 130, a bottom side 131 and a peripheral side edge 132, wherein the side edge 132 and/or the bottom side 131 has two run-up surface portions 133, 134 which respectively extend in a slanted or curved manner and are positioned and configured in such a way that the run-up surface portions 133, 134 cooperate with the container wall 20 when the operating part 60 is rotated from the unlocked position into the locked position. The run-up surface portion 133 is preferably located in the area of the portion 62 and/or 65 of the operating part 60. The run-up surface portion 134 is preferably located in the area of the portion 61 and/or 63 of the operating part 60. As shown in FIG. 71, the run-up surface portions 133, 134 are positioned on opposite sides of the operating part 60.

Figure 72:
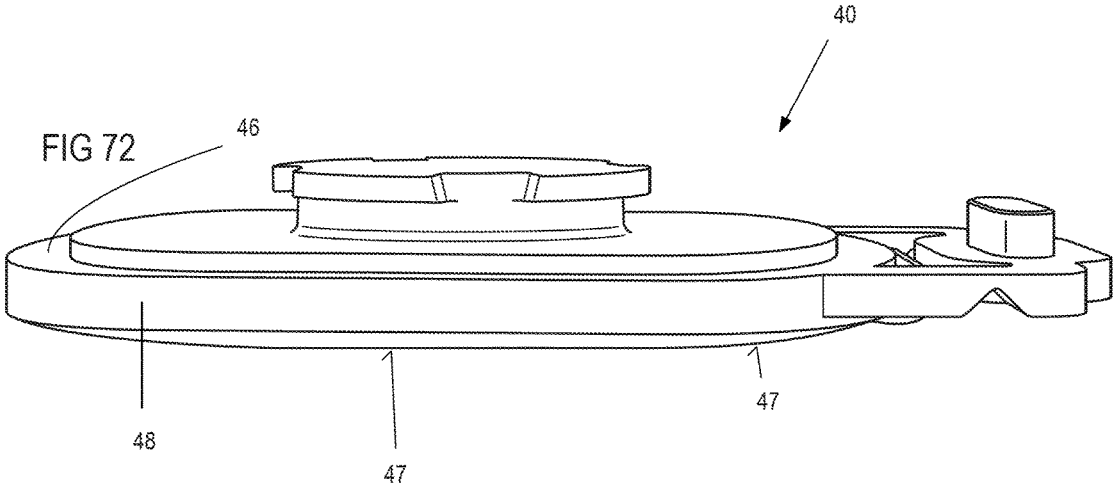
FIG. 72 is a perspective side view of an embodiment of the closure part of the container closure device according to the invention with a convexly formed bottom side of the closure part.

In an embodiment shown in FIG. 72, the closure part 40, viewed in a section extending perpendicularly to the container wall 20, has a component thickness that varies in a continuous manner. Preferably, the bottom side 47 of the closure part 40 is formed convexly for this purpose. Here, a base plate 48 of the closure part 40 is provided with a component thickness that increases along the longitudinal direction of the closure part 40 from the outside towards the inside. This results in an elasticity for the closure part 40 which is different in different portions and which, particularly in connection with the pressure present inside the container, makes an improved sealing effect, stability and elasticity in the desired areas of the closure possible. Alternatively or additionally, the bottom side 47 can be configured in a step-shaped manner.

LIST OF REFERENCE SYMBOLS

10 Container closure device
20 Container wall
21 Inner face
22 Outer face
23 Container opening
24 Opening limiting region
25 Boundary line (of 23)
26 Attachment opening
27 Border line
30 Closure unit
31 Closure region
32 Attachment region
33 Main body
34 Projection
35 Supporting region
36 Rivet connection
37 Joint
38 First main body portion
39 Second main body portion
40 Closure part
43 Connection receptacle
44 Outer closure part edge
46 Top side
47 Bottom side
48 Base plate
50 Operating device
60 Operating part
61 First locking portion
62 Second locking portion
63 First and region
64 Second end region
65 Central portion
66 Grip portion
67 Hole
68 Outer operating part edge
69 Connection projection
70 Displacement mechanism
71 Displacement
72 Projection
73 Control portion
74 Edge
80 Fixing device
81 Latching device
82 First latching member
83 Second latching member
84 Articulated connection
85 Latching flange
86 First flange portion
87 Second flange portion
88 Latching cam
90 Latching connection
91 Latching connection means (latching cam)
92 Latching connection means (latching cam)
94 Bayonet unit
95 Bayonet unit
96 Bayonet flange
97 Bayonet recess
100 Valve device
101 Valve opening
102 Valve passage
104 Valve sealing means A First axis
110 Sealing means B Second axis
111 First sealing region a Angle
112 Second sealing region
113 Connecting region
120 Seal device
121 Seal projection
122 Seal recess
123 Web (predetermined breaking point)
124 Intermediate space
125 wall
126 First connection
127 Second connection
128 First end
129 Second end
130 Top side
131 Bottom side
132 Side edge
133 Run-up surface portion
134 Run-up surface portion
140 Lever support device
141 Flange (support member)
142 Projection (support member)
143 Projection (support member)

The invention claimed is:

1. A container closure device for a container having a container wall with an inner face, an outer face and a container opening, the container closure device comprising:

a closure unit with a closure part for opening and re-closing the container opening multiple times, wherein the closure part is disposed on the inner face and so as to be pivotable from a closed position into an open position about a first axis extending substantially parallel to the inner face, an operating device with an operating part for actuating the closure part, wherein the operating part is disposed on the closure part in a manner rotatable about a second axis such that the operating part is connected to the closure part through the container opening and such that the operating part can be rotated from a locked position into an unlocked position, wherein the closure part closes the container opening in the locked position, and the container opening can be unblocked in the unlocked position by pivoting the closure part about the first axis, wherein the operating part has a first locking portion and a second locking portion, wherein the first locking portion and the second locking portion are configured in such a way that, in the locked position, the two locking portions extend beyond the container opening up to an opening limiting region delimiting the container opening, and that, in the unlocked position, at least one of the two locking portions does not extend beyond the container opening up to the opening limiting region delimiting the container opening.

2. The container closure device according to claim 1, wherein, when the operating part is rotated from the locked position into the unlocked position, the two locking portions move along the opening limiting region delimiting the container opening and/or along a boundary line of the container opening.

3. The container closure device according to claim 1, wherein an outer operating part edge of the operating part is configured substantially congruent to a boundary line of the container opening.

4. The container closure device according to claim 1, wherein the first locking portion and/or the second locking portion is an end region of the operating part.

5. The container closure device according to claim 1, wherein the operating part has a central portion between the first locking portion and the second locking portion, in which the rotatable connection between the operating part and the closure part is provided.

6. The container closure device according to claim 1, wherein, for rotatably connecting the operating part and the closure part, a connection projection and a connection receptacle are provided, wherein the one part of the operating part and/or the closure part comprises the connection projection and the other one of the operating part and/or the closure part comprises the connection receptacle.

7. The container closure device according to claim 1, wherein the rotatable connection of the operating part and the closure part is configured as a latching connection (clip connection), wherein the latching connection has two latching connection means, wherein at least one of them is configured in a partially elastic manner, and wherein one of the latching connection means is provided on the operating part and the other latching connection means on the closure part.

8. The container closure device according to claim 7, wherein the latching connection means are formed as latching cams on the connection projection and on the connection receptacle, respectively.

9. The container closure device according to claim 1, wherein the rotatable connection of the operating part and the closure part is configured as a bayonet connection.

10. The container closure device according to claim 9, wherein the bayonet connection has two bayonet connection units, wherein the one bayonet connection unit is provided on the operating part and the other bayonet connection unit on the closure part.

11. The container closure device according to claim 10, wherein the bayonet connection unit has at least one bayonet flange or one bayonet recess, wherein the bayonet flange or bayonet recess extends substantially parallel to the plane of the operating part or of the closure part.

12. The container closure device according to claim 11, wherein, for rotatably connecting the operating part and the closure part, a connection projection and a connection receptacle are provided, wherein the one part of the operating part and/or the closure part comprises the connection projection and the other one of the operating part and/or the closure part comprises the connection receptacle and wherein the bayonet flange or the bayonet recess of the bayonet connection unit provided on the closure part is disposed on the connection projection, and the bayonet flange or the bayonet recess of the bayonet connection unit provided on the operating part is disposed on the connection receptacle.

13. The container closure device according to claim 1, wherein the closure unit has a closure region formed on the closure part, for closing the container opening, and an attachment region for attaching the closure unit to the inner face of the container wall, wherein the closure part is connected to the attachment region via a joint and the joint provides the first axis.

14. The container closure device according to claim 13, wherein the attachment region has at least one projection which, for producing a rivet connection, can be inserted into an attachment opening of the container wall and secured with the container wall.

15. The container closure device according to claim 1, wherein a valve device with a valve opening and/or a valve passage is provided for pressure compensation between the container interior and the ambient pressure, and wherein the valve device is opened by rotating the operating part from the locked position into the unlocked position and closed by rotating the operating part from the unlocked position into the locked position.

16. The container closure device according to claim 15, wherein the valve opening and/or the valve passage is disposed in the closure part, the operating part and/or the sealing means.

17. The container closure device according to claim 1, wherein a sealing means is provided which is disposed on the closure unit and/or the operating device.

18. The container closure device according to claim 17, wherein the sealing means comprises a first sealing region, which seals the container opening relative to the closure part in the closed position, and/or comprises a second sealing means, which seals the attachment region of the closure unit with respect to the container wall.

19. The container closure device according to claim 1, wherein a seal device is provided which is damaged when the container closure device is opened for the first time, wherein the seal device comprises a seal projection and a seal recess, wherein the seal projection is connected to the operating part or the closure part via at least one predetermined breaking point, and the seal recess is provided in the other part of the closure or operating part, wherein, when the operating part is rotated, the seal projection cooperates with the seal recess in such a way that the predetermined breaking point is damaged.

20. The container closure device according to claim 19, wherein the seal projection is connected to the operating part and the seal recess is formed in the closure part or that the seal recess is formed in the operating part and the seal projection is connected to the closure part.

21. The container closure device according to claim 19, wherein the seal projection projects into the seal recess and the seal projection strikes against a wall of the seal recess and the predetermined breaking point is damaged when the operating part is rotated.

22. The container closure device according to claim 19, wherein, subsequent to damaging the at least one predetermined breaking point, when rotating the operating part, the operating part can be moved along the seal recess.

23. The container closure device according to claim 22, wherein the operating part can be moved along the seal recess in the form of the elongated hole, relative to the seal projection.

24. The container closure device according to claim 19, wherein a first connection is provided between the seal projection and the operating part, which is damaged when the container closure device is opened for the first time, and a second connection is provided between the seal projection and the operating part, which is not damaged when the container closure device is opened for the first time.

25. The container closure device according to claim 24, wherein the first connection and/or the second connection is configured as a positive, non-positive and/or substance-to-substance connection, and wherein the seal projection has a first end on which the first connection is formed, and has a second end on which the second connection is formed.

26. The container closure device according to claim 19, wherein the seal projection is connected to the operating part and/or the closure part via at least one web and/or the seal projection extends substantially perpendicularly to the operating part and/or the closure part and/or the seal projection comprises at least one seal pin and/or has at least one portion extending substantially parallel to the operating part and/or the closure part.

27. The container closure device according to claim 26, wherein the seal projection can be shaped with a T-Shape or L-shape.

28. The container closure device according to claim 1, wherein a lever support device is provided, which, during the pivoting movement of the closure part from the open position into the closed position, enables a leverage effect in such a way that the pivoting movement of the closure part towards the inner face of the container wall is supported up to the closed position of the closure part.

29. The container closure device according to claim 28, wherein the lever support device comprises a support member which is disposed or formed on the operating part or on the container wall, or that the lever support device comprises several support members, wherein at least one of the support members is disposed on the operating part and at least one other one of the support members is disposed on the container wall.

30. The container closure device according to claim 29, wherein the support member is disposed in the area of the locking portion or of the end region of the operating part in such a way that the support member is situated adjacent to the first axis.

31. The container closure device according to claim 29, wherein the support member is a projection or a flange protruding substantially perpendicularly or at an angle from the operating part or that the support member is disposed on a grip portion of the operating part or that the support member is disposed on the container wall.

32. The container closure device according to claim 1, wherein the operating part has a top side, a bottom side and a side edge, and the side edge and/or the bottom side has at least one run-up surface portion which extends in a slanted or curved manner and is positioned and configured in such a way that the run-up surface portion, in a position of the operating part shortly before reaching the unlocked position, cooperates as a run-up surface with the container wall.

33. The container closure device according to claim 32, wherein several run-up surface portions are provided which are positioned on opposite sides of the operating part.

34. A container comprising a container closure device according to claim 1.

35. The container according to claim 34, wherein the container is a beverage can.

* * * * *